US005590598A

United States Patent [19]

Keller

[11] Patent Number: 5,590,598

[45] Date of Patent: Jan. 7, 1997

[54] HORIZONTAL SHEET TRANSFER MULTIPLE COLOR OFFSET ROTARY PRINTING PRESS WITH HORIZONTAL SLIDE ACCESS

[76] Inventor: James J. Keller, 2410 E. Lenora St., Mesa, Ariz. 85213

[21] Appl. No.: 577,124

[22] Filed: Dec. 22, 1995

Related U.S. Application Data

[63] Continuation-in-part of Ser. No. 205,288, Mar. 1, 1994, Pat. No. 5,477,780, which is a continuation-in-part of Ser. No. 33,313, Mar. 15, 1993, Pat. No. 5,289,768, which is a continuation-in-part of Ser. No. 902,875, Jun. 23, 1992, Pat. No. 5,193,458.

[51] Int. Cl.[6] ..... B41F 1/34

[52] U.S. Cl. ..... 101/479; 101/216; 101/349; 101/425

[58] Field of Search ..... 101/479, 216, 101/219, 348, 349, 425, 151, 153, 174, 206, 137, 141, 147, 148

[56] References Cited

U.S. PATENT DOCUMENTS

| | | | |
|---|---|---|---|
| 637,579 | 11/1899 | Hett | 101/479 |
| 1,514,049 | 11/1924 | Ichida | 101/137 |
| 2,231,914 | 2/1941 | Huck | 101/184 |
| 2,460,504 | 2/1949 | Huebner | 101/479 |
| 3,283,710 | 11/1966 | Zahradnik et al. | 101/408 |
| 3,527,164 | 9/1970 | Bulk et al. | 101/137 |
| 3,598,045 | 8/1971 | Miller | 101/479 |
| 3,664,261 | 5/1972 | Dahlgren | 101/184 |
| 3,785,287 | 1/1974 | Dahlgren | 101/137 |
| 3,814,014 | 6/1974 | Dahlgren | 101/408 |
| 4,081,723 | 3/1978 | Vetter et al. | 101/232 |
| 4,404,905 | 9/1983 | Simeth et al. | 101/183 |
| 4,408,525 | 10/1983 | Rebel | 101/177 |
| 4,567,824 | 2/1986 | Dahlgren | 101/183 |
| 4,973,040 | 11/1990 | Kemp et al. | 101/216 |
| 5,085,143 | 2/1992 | Becker | 101/183 |
| 5,125,334 | 6/1992 | Marx et al. | 101/183 |
| 5,176,077 | 1/1993 | DeMoore et al. | 101/216 |
| 5,215,510 | 12/1993 | Hartung et al. | 101/142 |
| 5,392,710 | 2/1995 | Li | 101/219 |
| 5,467,712 | 11/1995 | Chou | 101/349 |
| 5,490,461 | 2/1996 | Beaudoin | 101/219 |
| 5,522,316 | 6/1996 | Singler | 101/479 |
| 5,528,986 | 6/1996 | Andersson et al. | 101/219 |
| 5,528,987 | 6/1996 | Andersson et al. | 101/219 |

*Primary Examiner*—Eugene H. Eickholt

*Attorney, Agent, or Firm*—John W. Montgomery; Ross, Clapp, Korn & Montgomery, L.L.P.

[57] ABSTRACT

A horizontal slide mechanism for removably replacing an inking unit set in a rotary offset printing press of the type having a plate cylinder, a blanket cylinder and an impression cylinder having parallel rotational axes. The horizontal slide mechanism includes a guide track rigidly mounted to the printing press adjacent and parallel to the plate, blanket and impression cylinders. A slide plate is supported in the guide track for guided movement parallel to the plate, blanket and impression cylinder transverse to the printing press. A pivot mount is attached to the slide plate and is pivotably attached to the inking unit. The pivot mount on the slide plate provides a single pivot axis parallel to the rotational axes of the plate, blanket and impression cylinders, and is positioned spaced apart from the plate cylinder for pivoting the inking unit between a first and a second pivot position. The first pivot position corresponds to inking engagement with the plate cylinder, and the second pivot position corresponds to a spaced apart disengaged position, at which the inking unit is not in operational engagement with the plate cylinder. A latching mechanism is provided by which the inking unit is releasably held and locked in the first position corresponding to inking engagement.

11 Claims, 14 Drawing Sheets

HORIZONTAL SHEET TRANSFER MULTIPLE COLOR OFFSET ROTARY PRINTING PRESS WITH HORIZONTAL SLIDE ACCESS

CROSS-REFERENCE TO RELATED APPLICATIONS

This is a continuation-in-part of prior U.S. patent application Ser. No. 08/205,288 filed Mar. 1, 1994, now U.S. Pat. No. 5,477,780 on Dec. 26, 1995; which is a continuation-in-part of U.S. patent application Ser. No. 08/033,313 filed Mar. 15, 1993 now U.S. Pat. No. 5,289,768; which is a continuation-in-part of prior U.S. patent application Ser. No. 07/902,875 issued Jun. 23, 1992 as U.S. Pat. No. 5,193,458.

TECHNICAL FIELD OF THE INVENTION

The present invention relates to a mechanism, system and method for removing and replacing an inking unit on a rotary offset printing press, and in particular to a horizontal slide mechanism and system for moving an inking unit for access to print rollers of a press and for replaceably removing and cleaning the inking unit.

BACKGROUND OF THE INVENTION

Rotary offset printing machines have been used for a number of years. The basic mechanisms, principles, and steps of operation for modern rotary printers include chemically forming an image on a thin metal image plate. The thin image plate therearound is attached around the circumference of a plate cylinder. Ink and a water solution are applied by inking unit rollers and dampening unit rollers to the respective chemically treated areas that are to form an image on the image plate as it rotates with the plate cylinder. The plate cylinder rolls the image plate against a blanket cylinder offsetting a reverse image around the circumference of the blanket cylinder. A sheet of print paper or other material to be printed is fed into the press and gripped by an impression cylinder. The impression cylinder pulls the paper into rolling contact between the bluet cylinder and the impression cylinder. Under rolling pressure between the two cylinders, the image is imprinted from the blanket cylinder onto the paper. The imprinted image is the reverse of that on the bluet cylinder so that it is appears as originally formed on the image plate. After the paper is imprinted, it is removed from the impression cylinder gripper and transferred to a collection tray, if printing is finished. If additional colors or images are to be applied, the sheet may be transferred to one or more other impression cylinders which grip the print paper from a transfer gripper and roll the paper against a subsequent blanket cylinder for additional printing. Alternatively, in some presses, a large impression cylinder carries the sheet past one or more additional blazer cylinders which roll the next color onto the sheet.

In multi-color offset printers, each color is applied as a series of minute dots or patterns. It is extremely important to precisely locate or register the paper as it is gripped by the impression cylinders, or each of them, so that each subsequent matrix of colored dots can be properly located and coordinated with respect to other color dots to form the desired image. Quality printing requires precise location of the dots within thousandths of an inch of each other. An error in alignment of a few thousandths of an inch can produce a blurred image or an image with improperly mixed and overlapping color dots.

In the past, multiple color offset rotary printers accomplished this precise registration through careful attention to the transfer of the paper using precisely manufactured fixed diameter transtar cylinders. Usually, the transfer cylinders are large enough to carry two sheets of print paper spaced end-to-end around the circumference of the cylinder. The rotation of the transfer cylinders had to be carefully timed with respect to the rotation of the impression cylinders so that the paper when picked up by the transfer cylinders from one of the impression cylinders was carried around the transfer cylinder at precisely the correct speed and distance so that it was gripped by a subsequent impression cylinder precisely in the correct location for registration. The grippers for each impression cylinder had to be adjusted until the dots were printed precisely at the desired location.

The use of transfer cylinders has been important because of the extreme criticality of precise registration. The cylinders, once formed, have a fixed diameter and can be rotated through gears at a fixed speed. Repeatable transfers are thus made possible. However, this structure is complex and expensive. Further, it introduces associate problems. For example, smearing can result because the printed surface of the paper being transferred is directed inward on each transfer cylinder. Thus, the printed surface of the sheet faces outward toward the blanket cylinder when it is gripped by the next impression cylinder. Special coatings, special non-stick screens, and even complex systems for air cushioning the paper as it is carried around the transfer cylinder have been employed in order to minimize this smearing problem.

The cost of manufacturing multiple color offset printers has been very high because of the complexity of multiple transfer gripping mechanisms, large precision-built transfer cylinders, and non-smear mechanisms. Further, because of the need to properly adjust registration of the paper as it is received by each impression cylinder, transferred to each transfer cylinder and then received by each subsequent impression cylinder, the time and expense to set up any given multiple color offset printing job has been substantial. It is not uncommon for an operator to spend a considerable amount of time setting up a job and to use over five hundred (500) trial printing sheets before proper registration is obtained for all of the color impression cylinders. As a result, multiple color offset rotary printing has not been economically feasible for most small printing jobs requiring less than several thousand copies.

Traditional rotary offset printing presses employ inking units, including sets of rollers, which rollers roll against each other and against the printing press plate cylinders. The rollers of the inking unit carry ink from an ink source for distributing and applying appropriate quantities of a desired colored ink onto the plate cylinder. The plate cylinder holds the printing plate which attracts the ink to an image to be printed. The ink image is transferred to the blanket cylinder for imprinting it onto individual sheets of paper which are held against an impression cylinder. There is often limited access area to the plate cylinder, the blanket cylinder and impression cylinder of the rotary printing press. It has been found to be desirable to allow the inking unit to be movable for purposes of allowing easier access to the main cylinders of the printing press.

Various devices have been developed with varying degrees of success for accomplishing the task of allowing access to the main cylinder of printing presses. One such device was disclosed in U.S. Pat. No. 4,896,599, issued to the present applicant, James J. Keller, titled Swing-Away Colorhead for Offset Duplicator. Such a device provided many advantages over fixed inking unit systems. For example, that device would allow access to the plate cylinder, or to the other internal mechanisms of the press. Still, there continues to be a need for a mechanism by which the entire inking unit could be conveniently moved for access withore removing the inking unit entirely, and also a mechanism which would allow the inking unit to be removed and replaced with another inking unit (e.g. an inking unit set up with a different color). Also, there was a need for providing a convenient mechanism and system by which an inking unit having been operated with one color of ink could be cleaned for use with another color of ink.

SUMMARY OF THE INVENTION

It is an object of the present invention to provide a multiple color rotary printing press with an inexpensive mechanism for transferring printing sheets therethrough with accurate registration alignment at each impression cylinder. A transferrable gripping bar is provided for gripping sheets to be printed. The transferrable gripping bar is provided with a registration projection. A corresponding projection receiving pocket is formed in each impression cylinder for accurately receiving the registration projection and holding the transferrable gripping bar in alignment. A conveyor band is attached to the gripper bar for moving the gripper bar from one impression cylinder to the next. Thus, a sheet of paper is gripped once by the gripper bar and is conveyed by the same gripper bar to each impression cylinder in the multiple color rotary offset printing press.

Another feature of the invention is the use of a registration projection which is a wheel having a V-shaped peripheral surface and a corresponding semi-circular shaped projection receiving pocket having a V-shaped rail corresponding to the peripheral shape of the wheel. The pocket rotates with each impression cylinder and the conveyor band carries the gripper bar to each impression cylinder so that the wheel rolls and slides into the pocket in precise registration alignment, both radially and axially with respect to the impression cylinder.

Another feature of the invention employs a registration projection on two spaced apart ends of the gripper bar with corresponding registration pockets at each axial end of the impression cylinder. A pair of parallel conveyor bands are attached at each end of the gripper bar to carry it suspended therebetween, as it is conveyed from one impression cylinder to the next. The gripper bar is attached to the conveyor band with a flexible bracket so that minor misalignment of the conveyor band with respect to precise registration is accommodated when the registration projection engages into the registration pocket. In this manner, inexpensive conveyor bands such as roller chains on sprockets or indexable belts on pulley gears can be employed as the conveyor band, even though minor deviations in the indexing of the band with respect to the rotation of the impression cylinders may result from wear or stretching and the like.

Another feature is to provide smooth positive engagement and disengagement between a registration projection wheel and receiving pockets at each impression cylinder. An entry guide is positioned at each impression cylinder to positively push the registration wheel into the receiving pocket while the paper to be printed becomes firmly engaged in printing contact between the impression cylinder and the blanket cylinder. An exit guide is also positioned at each impression cylinder to lift the registration wheels out of the receiving pockets so that the gripper bar moves smoothly away from the impression cylinder with the horizontal transfer chain. Parallel guides above and below the gripper bar hold the gripper bar in a horizontal orientation against twisting forces applied to actuate the gripper fingers.

Another feature is an actuation arm directly connected to rotate the gripper fingers between an open paper insertion position and a closed paper gripping position. The arm is actuated upwardly by a cam surface to an open position and is biased downward into a closed gripping position.

Another feature is the straight through transfer of printed sheets of paper from the gripper bar to a transfer gripper for removing and stacking printed paper.

Yet another feature is the use of idler sprockets in the return conveyor path for holding the gripper bars away from the impression cylinders. This reduces wear due to unnecessary engagement between projection wheels and receiving pockets during the return cycle.

It is an object of the present invention to provide a horizontal slide mechanism for removably replacing an inking unit in a rotary offset printing press of the type having a plate cylinder, a blanket cylinder and an impression cylinder having parallel rotational axes. The horizontal slide mechanism includes a guide track rigidly mounted to the printing press adjacent and parallel to the plate, blanket and impression cylinders. The guide track forms a predetermined shape for allowing a slide plate to move horizontally along the guide track. The slide plate is movably engaged in the guide track. A pivot mount is attached to the slide plate and is attached to the inking unit for providing a single pivot axis therebetween. The pivot axis of the pivot mount is parallel to the rotational axis of the plate cylinder. The pivot axis is spaced apart from the plate cylinder at a position for pivoting the inking unit between a first and a second pivot position, with the first pivot position corresponding to inking engagement with the plate cylinder, and the second pivot position corresponding to a spaced apart disengaged position at which said inking unit is not in engagement with the plate cylinder. A latching mechanism is provided by which the inking unit is releasably held and locked in the first pivot position corresponding to inking engagement with the plate cylinder.

Preferably, the guide track includes the first plurality of horizontally aligned rollers having a first predetermined profile shape and a second plurality of horizontally aligned rollers having a second predetermined profile shape. The first and second sets of horizontally aligned rollers are positioned parallel to each other, spaced apart a predetermined distance. The slide plate includes a first horizontal ridge having a cross-sectional shape corresponding to the reverse image of the first predetermined profile shape of the first set of rollers for rolling engagement therewith, and also including a second horizontal ridge having a predetermined cross-sectional shape corresponding to a reverse image of the second predetermined profile shape, parallel and spaced apart a predetermined distance from said first horizontal ridge, for simultaneous rolling engagement with the second set of horizontally aligned rollers.

It is a further object of the present invention to provide a guide track and slide plate which overlappingly extend in opposite directions a sufficient distance to provide support for the printing press for access to the plate cylinder and other areas of the press without complete removal of the inking unit.

It is a further object of the invention to provide a guide track which comprises concave V-shaped rollers with corresponding convex V-shaped profile for the horizontal ridges on the slide plate, so that the slide plate and the attached pivot mount are accurately maintained parallel to the axis of the plate cylinder.

It is a further object of the invention that the latching mechanism includes a cam lock device which both securely holds the inking unit in the first engaged position and which cam lock unit is provided with a locking pin so that the latching mechanism does not become inadvertently disengaged during operation.

It is a further object of the invention that the drive gear of the printing press automatically engages with the power receiving gear of the inking unit upon engagement in the first position and automatically disengages upon pivoting the inking unit to the second disengaged position. Preferably, the inking unit is provided with an external manual rotation knob by which the rotational position of a power takeoff gear of the inking unit can be adjusted slightly so that gear meshing with a press drive gear is accomplished without binding during movement from the second disengaged position to the first engaged position.

It is further object of the invention to provide a movable inking unit receiving tray having a horizontal receiving track for receiving the slide plate. The receiving tray is constructed so that the height of the receiving guide track can be adjustably positioned so that sliding transfer of the slide plate from the first guide track mounted to the printing press to the second guide track (i.e. the receiving guide track) mounted in the receiving tray is easily accomplished.

It is a further object of the invention to provide the receiving tray with ink cleaning capabilities by which an appropriate solvent can be directed to the ink rollers of the inking unit and so that used solvent liquid can be collected and so that solvent vapors can also be appropriately vented.

BRIEF DESCRIPTION OF THE DRAWINGS

The foregoing objects, advantages, and features, as well as other objects and advantages will become more apparent with reference to the description and drawings below, in which like elements represent like numerals and in which.

DETAILED DESCRIPTION OF THE PREFERRED EMBODIMENTS

Figure 1:
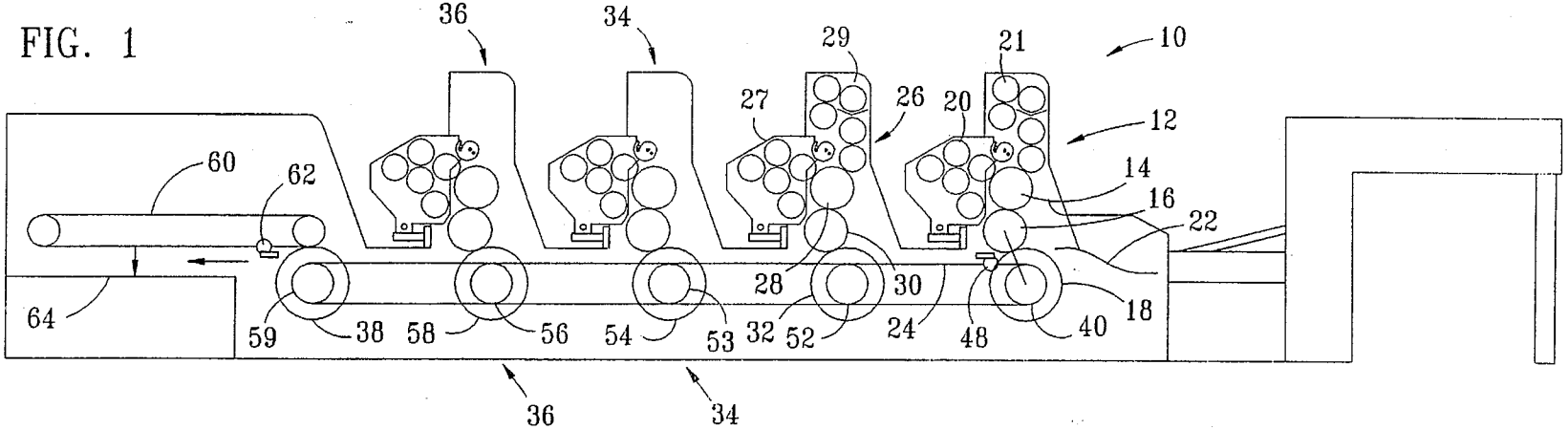
FIG. 1 is a schematic side view of a multiple color rotary printing press according to the present invention.

FIG. 1 shows a schematic side view of a multiple color offset rotary printing press 10. The press includes a first set 12 of color cylinders and rollers, including a first plate cylinder 14, a first blanket cylinder 16, and a first impression cylinder 18. An inking unit 20, including a plurality of inking rollers and a dampening unit 21, including a plurality of dampening rollers, are held and configured adjacent to the plate cylinder and in contact therewith. Ink and a dampening solution are thereby applied to a printing plate carried around plate cylinder 14. The image from plate cylinder 14 is applied in reverse to blanket cylinder 16. A sheet of paper 22 is fed between blanket cylinder 16 and impression cylinder 18 to imprint the image from the blanket cylinder onto the sheet 22 to be printed. In the embodiment shown in FIG. 1, the sheet 22 is conveyed on conveyor band 24 from the first set 12 to the second set 26 of color image applying cylinders. A second plate cylinder 28 receives ink from a second inking unit 27, and also receives dampening solution from a second dampening unit 29. A second color image is transferred to a second blanket cylinder 30 which in turn imprints the second color image on the sheet as it is rolled between blanket cylinder 30 and second impression cylinder 32. The sheet is carried along conveyor band 24 to each subsequent set of color cylinders and rollers 34 and last set 36. Each set operates substantially similar to the first and second sets to print an image or a portion of the image, such as one color formed of a matrix of dots or small patterns. After each matrix of dots and patterns are imprinted on sheet 22, it is transferred by conveyor band 24 to a skeleton cylinder 38 where it is released from the conveyor band 24 and carried by a delivery chain 60 to deliver the printed sheet to a collection tray 64.

Figure 2:
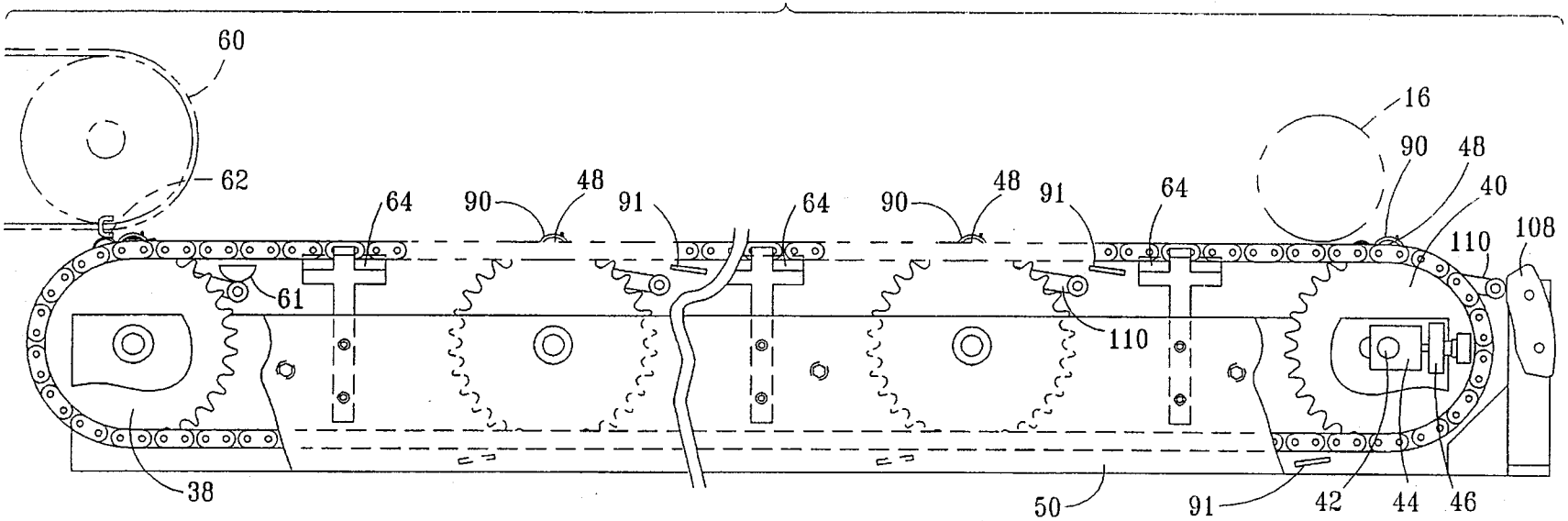
FIG. 2 is a side elevation view with partial cut-away portions showing an embodiment of a gripper bar conveyor band.

With reference to FIG. 2 which depicts a partially cutaway side view of the gripper bar conveyor mechanism for a multiple color offset rotary printing press, the structure and operation of the gripper bar 48 and conveyor band 24 in cooperation with the impression cylinders will be more fully understood. It will be noted that for purposes of clarity, the plate cylinders, the blanket cylinders, and the inking and dampening rollers are not depicted at each set of cylinders and rollers. However, the location only of blanket cylinder 16 is shown in FIG. 2 with phantom lines. Other cylinders and rollers will be correspondingly located as schematically set forth in FIG. 1. Conveyor band 24 is carried adjacent the periphery of first impression cylinder 18 by first drive wheel 40. Both the first drive wheel 40 and the first impression cylinder 18 are coaxially rotated on axle 42 which is supported for rotation by bearing block 44. Standard locking mechanisms (not shown) such as keys or set screws may be used to insure that the impression cylinders and conveyor drive wheels rotate together on the axle 42. Bearing block 44 may be adjustably secured to press frame 50 through adjustment mechanism 46 for appropriate adjustment of the spacing between the impression cylinders and for adjustment and appropriate tensioning of the conveyor band 24.

Conveyor band 24 is operatively connected attached to a gripper bar 48 so that the gripper bar is moved by the conveyor band from the first impression cylinder 18 to the second impression cylinder 32 and to subsequent impression cylinders 54 and 58. Uniquely, according to the present invention, the sheet is continuously held by gripper bar 48 so that the sheet is not released and regripped at each impression cylinder. Rather, the gripper bar is moved from impression cylinder to impression cylinder. The conveyor band is supported with drive wheel 40 at impression cylinder 18, drive wheel 52 at impression cylinder 32, and a drive wheel 53 at each subsequent impression cylinder 55 until the last impression cylinder 58 has a corresponding drive wheel 56. The conveyor band 24 continues around a drive wheel 59 which is attached to the skeleton cylinder 38, so named because there is no impression cylinder, but rather only the wheel 59 for returning the continuous conveyor band 24. The gripper bar 48 is attached to the conveyor band 24 so that it moves around skeleton cylinder 38 past the bottom of each impression cylinder 56, 54, and 52 and is re-engaged in proper registration with impression cylinder 18 for beginning the imprinting process again. The registration wheels 90*a* and 90*b* of gripper bar 48 register in registration pockets 88*a* and 88*b*, properly orienting gripper bar 48 with impression cylinder 18. A new sheet 22 is gripped by gripper bar 48 and is held securely as it is passed between impression cylinder 18 and blanket cylinder 16 for imprinting thereon. The registration of gripper bar 48 is repeated for all sets of printing cylinders. The sheet 22 is only then released to a delivery gripper 62 on delivery chain 60 which travels in close proximity to skeleton cylinder 38. Thus, after imprinting at last impression cylinder 58, the gripper bar 48 is carried and therefor carries the printed sheet 22 to skeleton cylinder 38 where gripper bar 48 is cam-actuated to release the sheet 22. Simultaneously, cam actuation of a delivery gripper 62 grips the printed sheet and caries it via delivery chain 60 to deposit it at a collection tray 64.

Figure 3:
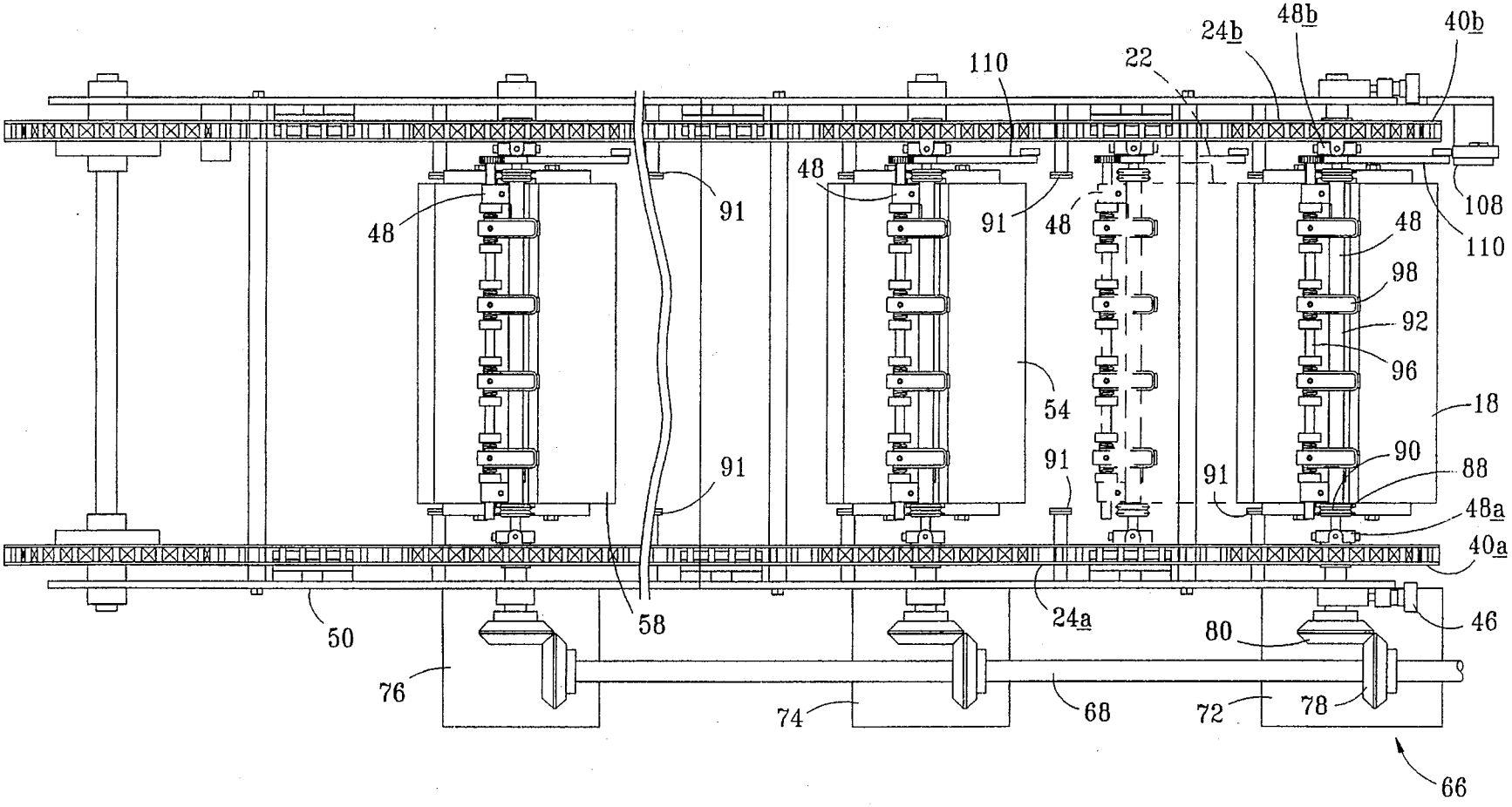
FIG. 3 is a top plan view showing multiple transferrable gripper bars and conveyor band and parallel conveyor bands according to the present invention.

The conveyor band 24 is depicted in a preferred embodiment, as shown in FIGS. 2 and 3, as a roller link conveyor chain 24 and carrier wheel 40 is depicted as sprocket 40. Conveyor bands constructed of other materials, such as belts, cables, cords, etc. may also be employed, provided that they are configured with an appropriate indexing means, such as that provided by the roller links and sprockets for the conveyor chains depicted, or such as that provided by uniform teeth on a fan belt (such as a timing belt) with corresponding pulley gears as drive wheels. The band 24 is thus flexible to form a continuous conveyor loop, yet is indexed to move correspondingly with the rotation of the impression cylinders. Means for attaching the gripper bars to the chain, belt, cable, cord, or etc. must also be provided. Links with attachment tabs are typically available for roller link chain. For purposes of clear explanation of the preferred embodiment shown in the Figures and clarity, conveyor band 24 will sometimes be referred to as conveyor chain 24 and the drive wheels carrying the conveyor band chain 24 will correspondingly be referred to as sprockets 40, 52, 56, and 38 as the case may be, for carrying conveyor chain 24.

Each of the drive sprockets 40, 52, and 56 rotate with the corresponding impression cylinders 18, 32, and 58, respectively. The distance between each impression cylinder is preferably fixed during operation. Axle bearings for each respective impression cylinder location are mounted on frame 50. The distance between each impression cylinder preferably corresponds to the maximum size of the sheet to be printed, which size corresponds to the circumferential impression cylinder surface. Adjustment of this distance may be accomplished with an adjustment mechanism 46.

The impression surface of each impression cylinder is less than the circumference of a circle of the same diameter because an opening 86 (as will be explained below) is formed in each impression cylinder. The gripper bar 48 fits into opening 86 and is to be registered, as described herein.

Each impression cylinder is directly driven in synchronization with each other impression cylinder as through a power gear train 66 interconnected from each impression cylinder to the power supply (not shown). The conveyor band 24 may transmit power from one cylinder to the next, but is preferably not for transmitting rotational force to the impression cylinders. Rather, power is preferably provided from each impression cylinder to the conveyor band to move it in synchronization with each impression cylinder. This reduces the strain, wear, and stretching of the conveyor band or conveyor chain and therefore maintains closer synchronization with each impression cylinder as the conveyor band is driven thereby. As some wearing or stretching may nevertheless occur, the chain is preferably supported between each of the drive sprockets, as with multiple support rails 64, which are securely fastened to frame 50.

FIG. 3 schematically depicts the impression cylinders 18, 32, 54, and 56 in a top view with the corresponding blanket cylinders, plate cylinders, inking rollers, and dampening rollers removed. The power train 66 may be any conventional gear driven power train by which impression cylinders 18, 32, 54, and 58 are driven at the same rotational speed. A drive shaft 68 is rotated by a power source and advantageously drives each of the impression cylinders through a bevel gear power transmission unit at each impression cylinder. The number of bevel gear transmission units will correspond to the number of impression cylinders. In FIG. 3, bevel gear transmission units 72, 74, and 76 are depicted. An advantageously simple bevel gear transmission unit 72 comprises a drive bevel gear 78 coaxially affixed to shaft 68. Bevel gear 78 meshes with axle gear 80, which is coaxially affixed to impression cylinder 18. Preferably to reduce wear and to maintain accurate synchronization, helical bevel gears 78 and 80 are used.

Further in the preferred embodiment, as shown in FIG. 3, multiple gripper bars 48 will be carried by conveyor band 24, each spaced apart therealong at a distance corresponding to the distance between each impression cylinder. Each gripper bar 48 holds a separate sheet 22 to be printed. Thus, each set of impression cylinders and blanket cylinders applies its image to a sheet 22 as it is carried through the rotary printing process. An intermediate position for a gripper bar 48 is depicted in phantom lines between impression cylinder 18 and impression cylinder 32 to show how the gripper bar moves from one set of printing cylinders to the next. A sheet 22 is securely held by each gripper bar 48 as it is conveyed from first impression cylinder 18 to second impression cylinder 32, from second impression cylinder 32 to third impression cylinder 34, and to each subsequent impression cylinder to the last impression cylinder 58.

As also shown in FIG. 3, conveyor band 24 preferably comprises a pair of conveyor bands 24*a* and 24*b* or conveyor chains 24*a* and 24*b*, which move continuously parallel and synchronized from one impression cylinder to the next. In this embodiment, gripper bar 48 is attached at spaced apart locations, such as at each of its ends 48*a* and 48*b* to chains 24*a* and 24*b*, respectively. Sprockets 40*a* and 40*b* are coaxially mounted at each end of each impression cylinder and are rotated coaxially therewith. The sprockets 40*a* and 40*b* carry and drive the conveyor chains and gripper bars from one cylinder to the next as described above.

Figure 4:
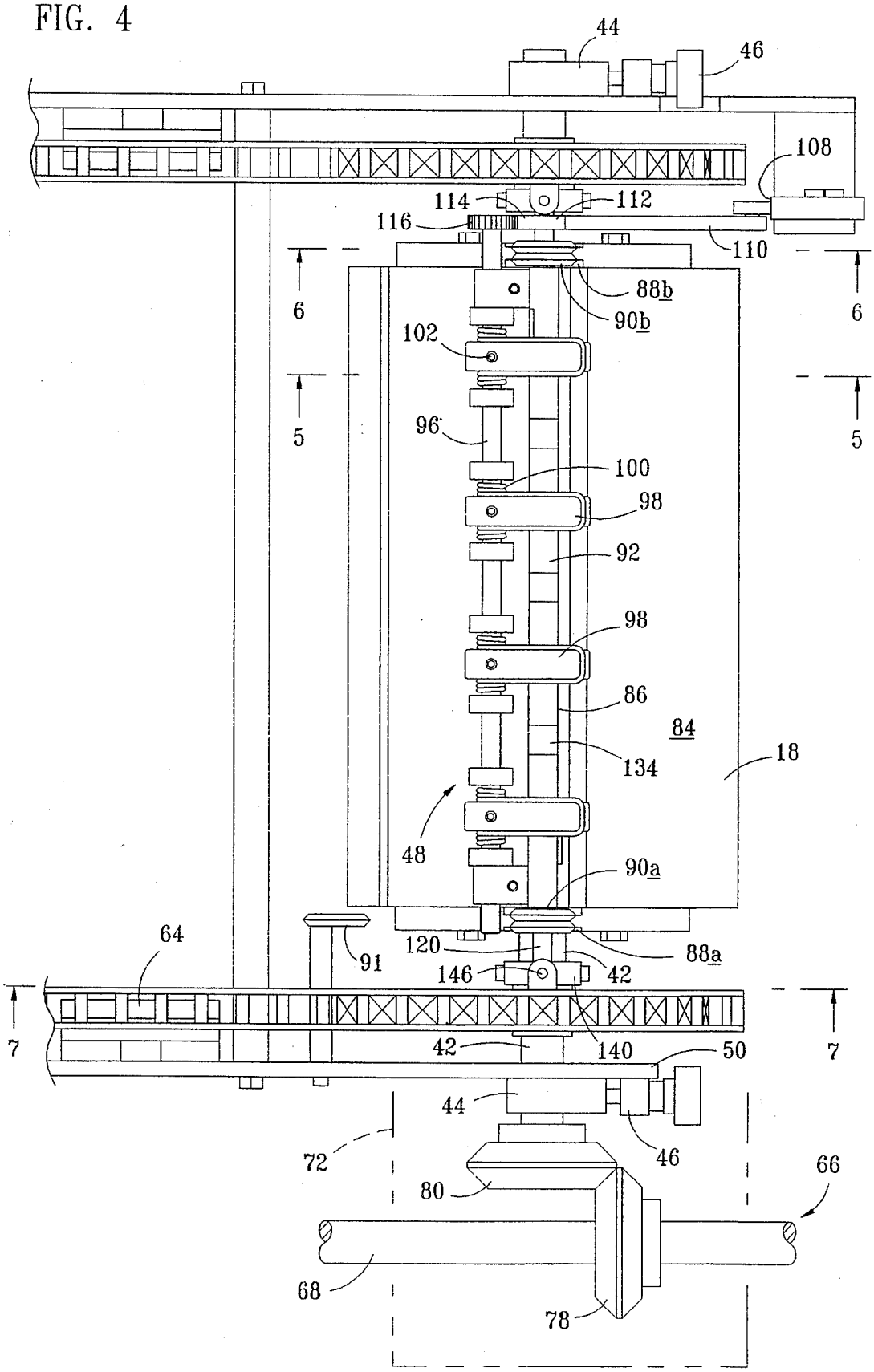
FIG. 4 is a partial top plan view detail of one of the impression cylinders and transferrable gripper bars according to the present invention.

The details of construction and operation of the gripper bar and conveyor mechanism according to the present invention can be more fully understood with reference to FIG. 4, which is an enlarged partial cut-away top plan view of impression cylinder 18 and gripper bar 48. It will be understood that the construction is similar for each impression cylinder in a multiple cylinder rotary press. The impression cylinder 18 is preferably formed of a rigid metal casting having a hollow central portion 82 to reduce weight, and a ground cylindrical surface 84 against which printing impression occurs. The cylindrical surface 84 is interrupted by an opening 86 into the hollow central portion 82. Preferably, the opening 86 extends or interrupts the otherwise continuous cylindrical surface 84 for less than approximately one cylindrical quadrant of the entire cylindrical surface 84. A registration pocket 88 is formed adjacent the cylindrical opening 82 for receiving registration projection 90 attached to gripper bar 48. In the preferred embodiment, registration pocket 88 comprises two axially spaced apart registration pockets, 88*a* and 88*b* for receiving corresponding registration projections 90*a* and 90*b* attached spaced apart on the gripper bar, as will be explained more fully below. The use of two spaced apart pockets and projections advantageously provides stability and facilitates repeatable registration from one set of printing cylinders to the next.

Although a single registration pocket 88 with a single registration projection 90 could be advantageously used over previously known presses to allow a gripper bar to register from one cylinder to the next according to the present invention, it is preferable to have two pockets axially disposed on either end of the impression cylinder 18 and either end of gripper bar 48, respectively. Ease of alignment and adjustment for securely holding the gripper bar in proper registration while imprinting is initiated and is also facilitated by this preferred construction.

The gripper bar 48 is preferably constructed of a strong, rigid material, such as steel, which is appropriately hardened for strength and to resist wear and abrasion. The gripper bar may be constructed having a main beam 92 onto which an exterior flat surface 94 is formed. A gripper shaft 96 is attached to main beam 92 in a parallel orientation spaced ahead of main beam 92 in the direction of motion. Multiple individual gripper fingers 98 are pivotably attached to shaft 96 for pivoting into gripping engagement with the flat surface 94 of the main beam 92. In the preferred embodiment shown, each of the individual gripper fingers 98 are pivotably attached to shaft 96 and resiliently biased toward gripping engagement. Shaft 96 appropriately engages with each of the individual gripper fingers 98 at 102 so that partial rotation of the shaft 96 causes lifting of all of the individual gripper fingers 98 against clamping bias springs 100. In this manner, a space is opened between a horizontal gripper face 104 and flat surface 94. A vertical surface 106 is preferably formed on each gripper finger 98, uniformly spaced from the gripper shaft 96. A cam 108 operates an arm 110 to partially rotate shaft 96 to open the gripper fingers 98. An edge of a sheet 22 to be printed, such as a piece of printing paper, is fed into the gripper opening between flat surface 94 and gripper face 104. The edge of sheet 22 abuts against this vertically projecting surface 106, thereby locating it circumferentially with respect to the impression cylinder, as it is fed into the gripper finger 98. The sheets are fed between runners (not shown) to properly orient them in the axial direction with respect to the first impression cylinder 18. As the cam arm 110 follows around cam 108, it is actuated to close the gripper fingers 98 against flat surface 94. In the preferred embodiment, gripper fingers 98 are biased or spring-loaded toward a closed position. Cam arm 110 moves the gripper finger against the springs 100 when it contacts cam arm 108, and releases the gripper fingers to close when cam arm 110 moves past cam 108. Thus, the gripper fingers 98 are permitted to clamp down on the sheet 22. Sheet 22 is drawn by the gripper bar, which rotates with the impression cylinder 18, into printing or rolling engagement between the impression cylinder cylindrical surface 84 and the corresponding blanket cylinder 16.

Registration projections 90 are rigidly attached to the gripper bar 48. Each projection 90 is received into the registration pocket 88 which is rigidly affixed to the impression cylinder 18. This construction repeatably holds the gripper bar 48 in proper alignment or proper registration of sheet 22 with respect to the impression cylinder 18. The flat surface 94 of the beam 92 is positioned slightly below, but substantially parallel to the cylindrical surface 84 of the impression cylinder 18. The parallel alignment holds the sheet 22 straight on cylinder 18 and avoids variations in circumferential orientation from one end of the cylinder to the other. Pocket 88 further cooperates with the registration projection 90 to hold the gripper bar in axial alignment (i.e., maintaining the gripper bar in proper side-to-side alignment with the impression cylinder). The gripper bar 48 is also held in circumferential registration by registration wheel 90 and registration pocket 88. The registration of each gripper bar is preferably synchronized with each subsequent impression cylinder so that the image or the matrix of color dots applied at each impression cylinder is coordinated with each other image or color applied at each other impression cylinder.

To facilitate rapid alignment of the projection wheel 90 for insertion into pocket 88, a pre-alignment V-shaped rail 91 is affixed to the printer at a slight angle with respect to the path of the projection wheel 90 and positioned so that the V-shaped projection wheel 90 is smoothly moved along the rail 91 into proper pre-alignment with the registration pocket 88 so that proper engagement of the projection wheel within the projection pocket 88 is facilitated at each set of printing cylinders.

Figure 5:
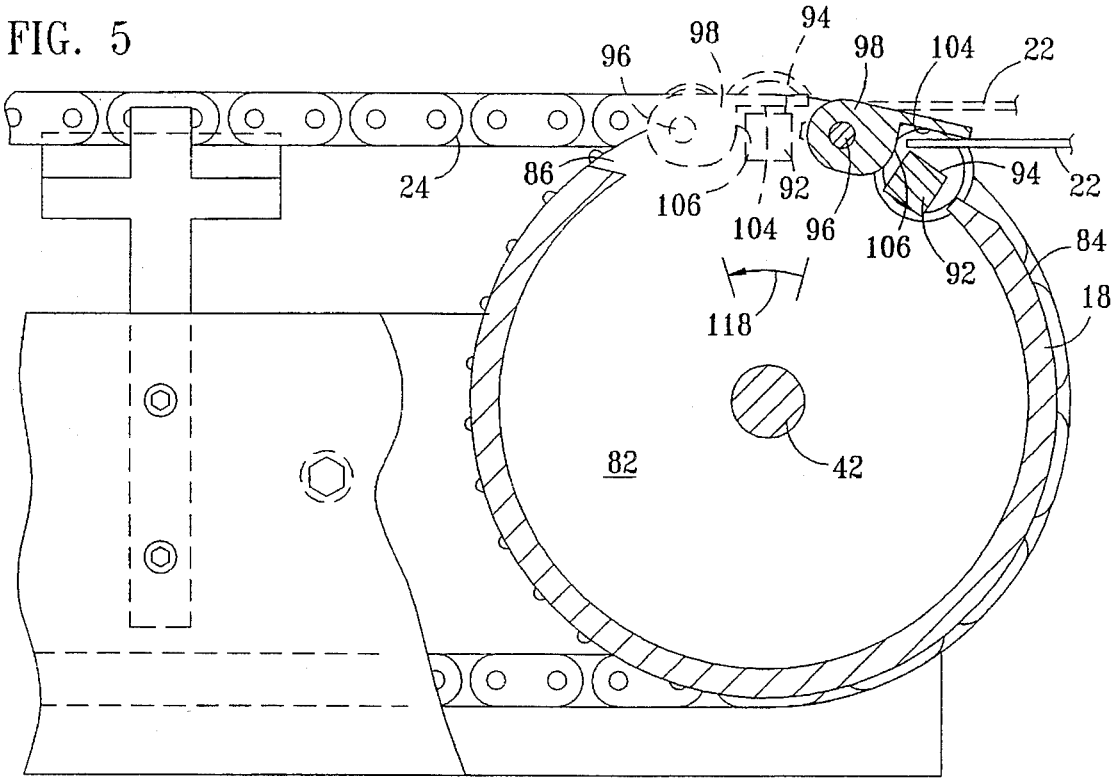
FIG. 5 is a partial detail side section view of the first impression cylinder taken along line 5—5 of FIG. 4, showing gripper orientation.
Figure 6:
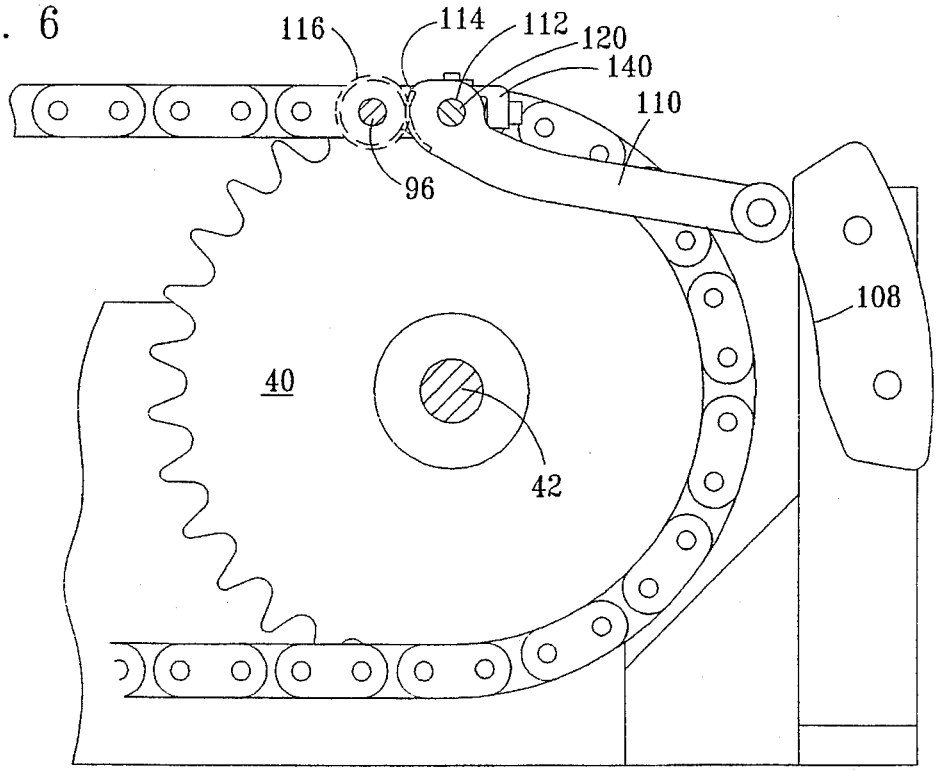
FIG. 6 is a partial section view taken along line 6—6 of FIG. 4, showing details of the cam associated with the movable gripper of the invention.

The operation and construction of the gripper finger may be further understood with reference to FIGS. 5 and 6, in which FIG. 5 is a cross-sectional view of the gripper bar conveyor assembly of FIG. 4, taken along section line 5—5 and FIG. 6 is a section view taken along section line 6—6. In FIG. 5, an individual gripper finger 98 is shown in an open position in solid lines and in a closed position in phantom lines. The gripper finger 98 has a horizontal or gripping face 104 and a vertical surface 106. A cam 108 which is fastened to the frame 50 actuates a cam arm 110 (shown in FIG. 6 in a corresponding closed position in solid lines and a corresponding open position in phantom lines). In this manner, the gripper bar 48, which is fastened to the conveyor band 24 at either end, is carried around impression cylinder 18. The cam arm 110 is attached to gripper bar 48 and becomes engaged against cam 108, thereby partially rotating cam arm 110 about a pivot 112 so that gear teeth 114 formed at the pivot end of cam arm 110 mesh with gear teeth 116 at the end of shaft 96 to partially rotate the shaft 96. The individual gripper fingers 98 are pivoted about shaft 96 to form an opening between horizontal surface 104 and flat surface 94. In a subsequent position in the rotation of impression cylinder 18, gripper finger 98, as shown in phantom lines, is moved an angular distance 118 which in turn moves the cam arm 110 out of engagement with cam 108. Springs 100 are thus permitted to push the gripper fingers 98 downward against paper 22 to hold it securely between flat surface 94 and horizontal gripper face 104. As can be seen in FIG. 5, the entire gripper bar 48 fits within opening 86 into the hollow central portion 82, so that it is below the path of travel of the circumferential surface 84 of the impression cylinder. The gripper fingers 98 extend beyond the surface only when opened, so that they pass below blanket cylinder 16 when they are in a closed, sheet gripping position.

Figure 7:
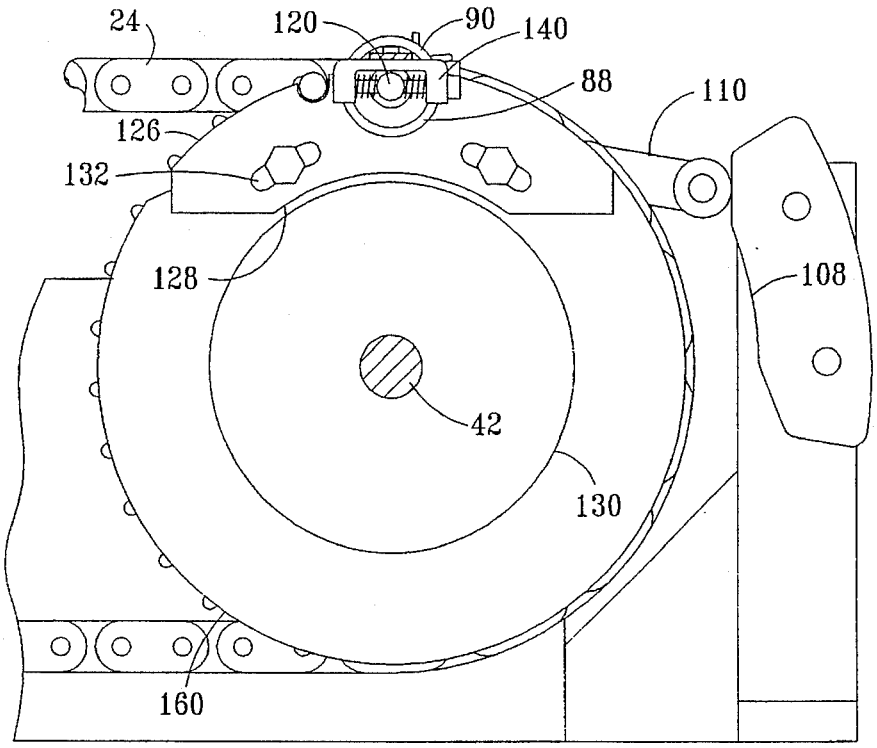
FIG. 7 is a partial section view taken along line 7—7 of FIG. 4 showing details of the assembly of a preferred embodiment of a registration pocket and flexible bracket for holding the gripper bar to the conveyor band.
Figure 8:
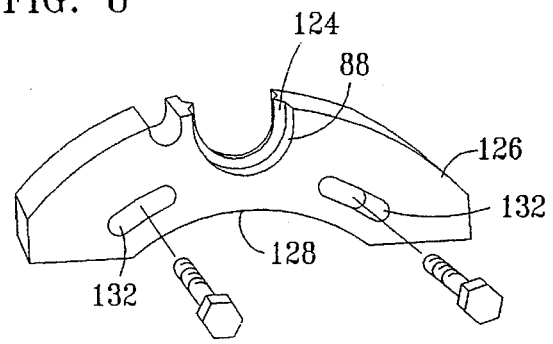
FIG. 8 is a detail perspective view of a preferred embodiment of a registration pocket which is adjustably affixable to the impression cylinder.
Figure 9:
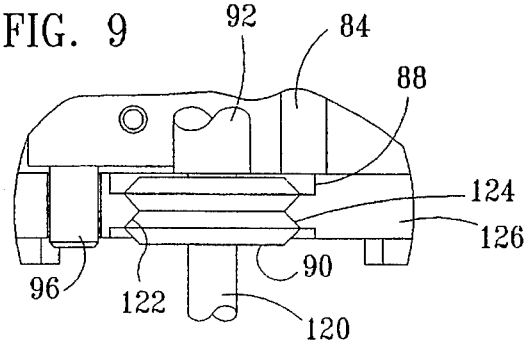
FIG. 9 is a top plan view of a preferred embodiment of a registration projection wheel engaged within a registration pocket according to the present invention.

In the preferred embodiment shown, as more clearly depicted with reference to FIGS. 7, 8, and 9, the construction and attachment of registration pocket 88 and registration projection 90 may be more fully appreciated. FIG. 7 is a partial section view along section line 7—7 of FIG. 4. FIG. 8 is a perspective view of a registration plate into which registration pocket 88 is formed. FIG. 9 is a partial cut-away top view of a registration wheel 90 engaged in registration pocket 88. Thus, in the preferred embodiment shown, projection 90 comprises a wheel 90 having a circular peripheral surface 122, which has a uniform V-shaped cross-sectional profile. The registration pocket 88 has a corresponding reverse image V-shaped rim 124. The pocket 88 is preferably formed in an adjustably attachable plate 126 which has a curved surface 128 corresponding in size to a circular boss 130 formed at both ends of the impression cylinders. The curved surface 128 of plate 126 is sized to fit against circular boss 130 so that the radial position of the gripper bar 48 is properly and accurately spaced in a radial direction for each identically machined circular boss 130 on each end of each impression cylinder. When the projection wheel 90 is fully inserted into registration pocket 88 so that V surface 122 of wheel 90 is fully seated against V surface 124 of pocket 88, the nature of complementary V-shaped surfaces 122 and 124 are such that the projection wheel 90 fits into the pocket 88 in axial alignment. Wheel 90 is affixed to attachment shaft 120 for rotation, but is not movable with respect to shaft 120 in an axial direction. Thus, movement of wheel 90 as "V" 122 engages rim 124 moves the entire gripper bar 48 into proper axial alignment. Slotted holes 132 are preferably milled in an arc so that the plate 126 can be positioned circumferentially about the impression cylinder without changing the radial position of the pocket 88. When the plate is properly positioned, it is rigidly affixed using, for example, threaded fasteners 134 to hold the plate fixed relative to the impression cylinder. Wheel 90 is sized to roll into the pocket 88 and is held in the proper circumferential position. Using identically sized and shaped wheels for each gripper bar and identically sized pockets for each impression cylinder provides registration which is repeatable each time the gripper bar is moved into position for engagement of projection wheel 90 into pocket 88.

Figure 10:
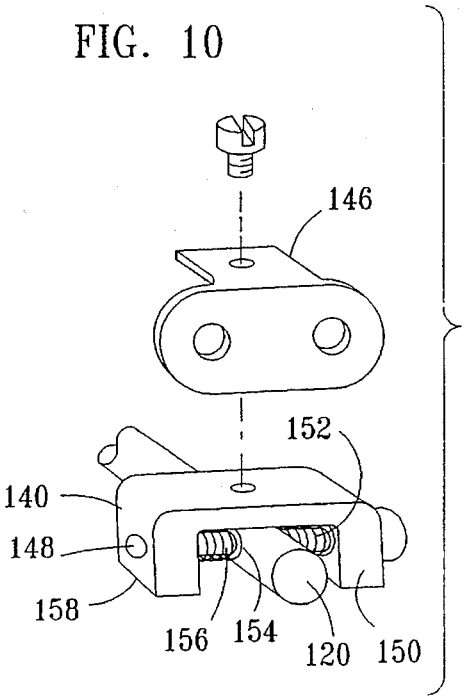
FIG. 10 is a perspective assembly view showing details of the flexible attachment bracket according to the present invention.

As the conveyor band 24 may stretch or wear slightly in a linear direction during operation, it is important that registration be accomplished independent of the position of the gripper bar with respect to its attachment to the conveyor band or chain. FIGS. 7 and 10 depict a unique flexible bracket 140 which advantageously interconnects the conveyor band 24 with attachment shaft 120 to securely attach the gripper bar to the conveyor band, while permitting a small amount of movement in a linear direction with respect to the conveyor band or a circumferential direction with respect to the impression cylinder. In the case of a conveyor chain, as shown in FIG. 10, the bracket 140 is a "U" shaped bracket attached to the chain using a side projecting tab 146. Links with tabs are standardly available for roller chain. Other means for attaching a flexible bracket 140 to other types of conveyor bands may also be adaptable, depending on the band material used. Bracket 140 may be constructed with a pin 148 inserted through one end 150 of the U bracket. Pin 148 extends through a resilient spring 152, through an orifice 154 in attachment shaft 120, through a second resilient spring 156, and into an opposed end 158 of U-shaped bracket 140. Attachment shaft 120 is smaller than the space between ends 150 and 158 so that shaft 120 can move slidingly along pin 148 in either direction by compressing springs 152 or 156. Thus, small amounts ofmisalignment between the conveyor band and the proper registration position as defined by pocket 88 and registration projection wheel 90 will be automatically accommodated as projection wheel 90 moves into pocket 88 and as V-shaped surface 122 seats against V-shaped rim 124.

Thus, when the first impression cylinder 18 is rotated, it engages a gripper bar at the bottom junction 160 between the conveyor band 24 and the impression cylinder 18. The projection wheels **90*a* and 90*b* properly locate the gripper bar 48 at both ends of the cylinder 18. The gripper bar 48 is rotated circumferentially around the impression cylinder 18 until cam arm 110 engages cam surface 108 to open the gripper fingers 98. When the gripper fingers 98 are opened, a sheet 22 to be printed is fed horizontally against the vertical surface 106 of the gripper finger 98. As the cam arm 110 moves out of engagement with cam surface 108, the gripper fingers securely clamp onto the sheet 22. As the impression cylinder 18 continues to rotate, sheet 22 is drawn by the gripper fingers 98 into rolling engagement between impression cylinder 18 and the blanket cylinder 16 to thereby initiate with proper registration of sheet 22 as it is printed. After printing is initiated, the pressure between the blanket cylinder 16 and the impression cylinder 18 continues to hold sheet 22** in non-slip engagement as it is printed. Those skilled in the art will understand that substantial pressure is imparted between the impression cylinder and the blanket cylinder during rotary printing. The magnitude of the pressure varies from press to press and from printing job to printing job. However, high pressures are not uncommon, depending upon the size of the impression cylinders involved.

As the impression cylinder 18 continues to rotate, conveyor band 24 attachment moves horizontally toward the next set of printing cylinders, so that bracket 140 effectively "lifts" the gripper bar 48 out of the impression cylinder, thereby disengaging registration projecting wheel 90 from registration pocket 88. The conveyor band moves the gripper bar to the next impression cylinder which is synchronized, through spacing and proper indexing of the conveyor band, for engagement of projecting registration wheels 90 into registration with identical registration pockets 88 positioned on subsequent impression cylinder 32. Registered alignment is accomplished during a portion of the rotation sufficient to initiate printing and the gripper bar is moved in like fashion to each subsequent impression cylinder 54 and 58. It being understood that while four or fewer impression cylinders have been shown in the embodiments depicted, greater or fewer numbers of impression cylinders may be used with the same inventive principles. Once again, the second and subsequent sets of printing cylinders need not be provided with a cam 108 for operating the gripper fingers 98 because once the gripper bar grips a sheet 22, it need not be released until the printing is completed. The paper is thus positioned in proper registration with respect to each impression cylinder by means of the accurate registration of the wheel 90 into pockets 88. When the printing is completed, the gripper bar 48 is moved to return to a skeleton cylinder 38, which comprises return drive wheels 38 for redirecting the continuous conveyor band 24 under impression cylinders and back to first impression cylinder 18 to initiate the cycle again. The spacing between each cylinder is the same on the top and the bottom so that the projection wheels 90 may be reinserted into pockets 88 without effect as they pass underneath each impression cylinder.

As shown in FIG. 2, the sheet 22 may be advantageously released directly from gripper bar 48 to delivery chain 62. Arm 110 engages release cam 61 as delivery gripper 62 is simultaneously activated to grab onto the printed sheet 22. Channels 134 formed in gripper bar 48, accommodate delivery grippers 62 so that sheet 22 continues horizontally out of the press without bending or otherwise changing directions. This avoids the need to keep the sheet bending when the delivery chain grabs the printed paper. Thus, the present invention avoids tracking or smearing often associated with devices used to assist continuous bending of the sheets to avoid bunching at the delivery chain pickup. The printed sheets are delivered and released into a collection tray 64.

Figure 11:
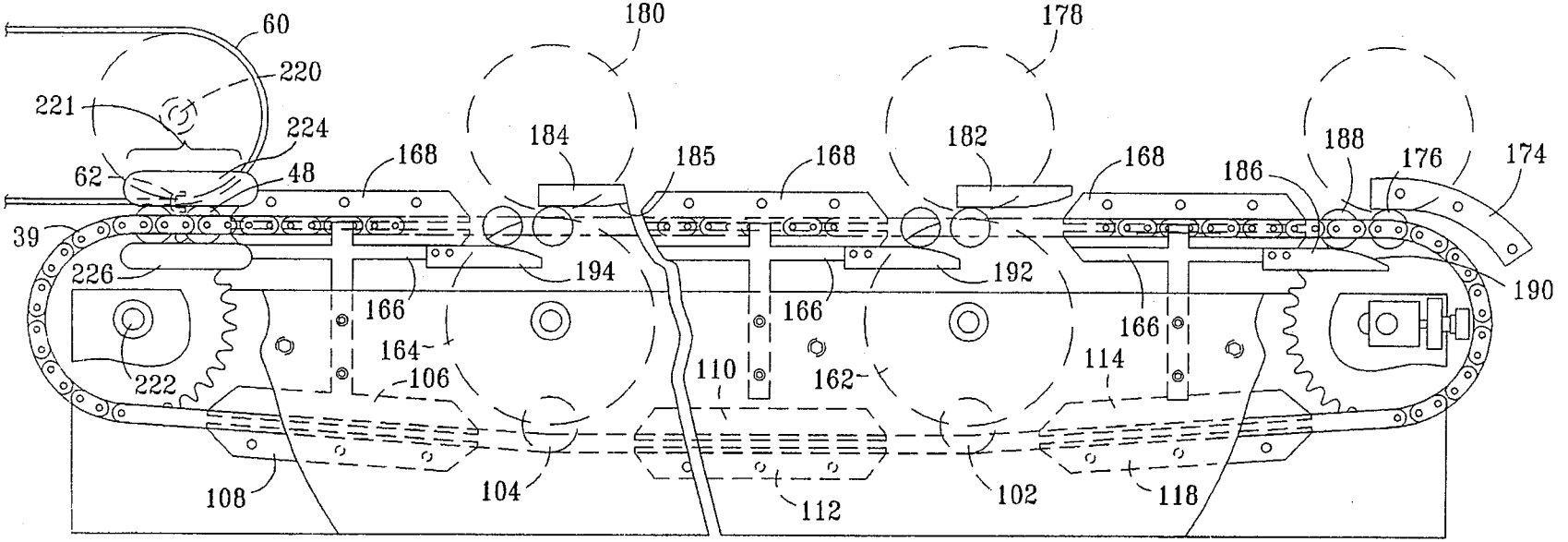
FIG. 11 is a schematic side view of an alternative embodiment of a multiple color rotary printing press according to the present invention.

In the alternative embodiment depicted in a schematic side elevation view of FIG. 11, initial impression cylinder 18 is at one end of the printing press with a pair of sprockets 40, around which conveyor chain 24 travels carrying the transferable gripper bar 48 from one impression cylinder to another. At the other end of the press is a return sprocket 39, around which the continuous conveyor chain 24 travels to return the chain to the initial impression cylinder 18. Intermediate impression cylinders 162 and 164 are positioned at regular spaced apart intervals, distances corresponding to the circumferential dimension which the registration pocket travels around each of the impression cylinders. While two intermediate impression cylinders are depicted, it will be understood that multiple impression cylinders of a desired number of different colors or printing stages can be employed without departing from the invention. In the embodiment shown in FIG. 11, the intermediate impression cylinders do not have corresponding co-rotating transfer sprockets, but rather the conveyor chain 24 is guided with chain guides 166 above and slide guide chain 168 below, so that the conveyor band moves along a path which carries the registration wheels on the gripper bar in a path which tangentially coincides with the rotation path of the registration pockets on each of the impression cylinders.

Also depicted in FIG. 11, there is an entrance guide 174 correspondingly located for rolling contact with guide roller 176, such that rolling contact between the entrance guide roller and the entrance guide securely forces the registration roller firmly seated in the registration pocket, while rolling contact is initiated between each of the impression cylinders 18, 162, 164 and the corresponding blanket cylinders 16, 178 and 180.

In the case of each intermediate roller 162 and 164, an entrance guide 182 and 184, respectively, are positioned with a slight downward angled ramp surface 183 and 185, respectively, so that guide roller 176 on each gripper bar is forced downwardly into secure engagement to force registration roller into firm engagement in each registration pocket.

Also depicted at initial impression cylinder 18 is an exit guide surface 186 and an exit guide roller 188. Guide 186 has an upwardly directed ramp surface 190 against which exit guide roller 188 is lifted smoothly out of registration engagement after rolling contact with the sheet to be printed is initiated between impression cylinder and corresponding blanket cylinder. Similar exit guides 192 and 194 are correspondingly positioned for tangential lifting of the registration rollers out of the registration pockets at each impression cylinder 162 and 164, respectively. It will be noted that exit guide 186 at the initial impression cylinder 18 has a portion of its contact surface 190, against which exit roller 188 is in contact simultaneously while entrance guide roller 176 is in contact with entrance guide 174. This arrangement permits an upwardly directed force against a cam actuation arm 196 through a cam 198, which upward lifting force would normally cause twisting movement in the gripping bar, but for contact of roller 176 with entrance guide 174 and exit roller 188, with exit guide 186. In this manner, the twisting moment asserted through the arm in raising the gripper fingers for accepting a sheet to be printed is held in a horizontal orientation through the force couple exerted through the spaced apart rollers 176 and 188.

After the conveyor chain 24 moves the gripper bar around return sprocket 39, the sheet has been removed and there is no need for the gripper bar and registration rollers to reinsert themselves into each registration pocket at each impression cylinder 164 and 162. Thus, in order to further reduce wear, deterioration and any other potentially adverse effects, the conveyor chain 24 is guided around idler sprockets 204 and 202 at a slight spaced apart distance so that there is no contact between the gripper bars and each of the impression cylinders 164 and 162 as the gripper bar is returned to the initial impression cylinder 18. The lower conveyor band guides 206 and 208 are angled slightly downward to keep conveyor band 24 from shaking as it moves around idler 204. The guides are substantially parallel at 210 and 212 in between each intermediate impression roller 162 and 164 and then they angle upwardly from idler sprocket 202 to initial sprocket 40 as with guides 214 and 218.

As indicated previously, the gripper bar 48 is activated to release the sheet after it is printed and prior to moving around return sprocket 39. Simultaneously, a transfer chain 60 with a transfer gripper 62 thereon grabs onto the sheet that is printed and carries it horizontally without bending to a deposit stack. It has been found that in the preferred embodiment the center 220 of return chain sprocket 61 is positioned overlappingly forward or upstream of the direction of motion of the conveyor band from the center 222 of return sprocket 39. Also, there are parallel guides 224 and 226 which hold conveyor band 24 parallel in an overlapping section 221 with transfer chain 60 so that transfer gripper 62 and movable gripper bar 48 can simultaneously hold the sheet while it is an orientation parallel to and in the parallel transfer section 221. Subsequently, the gripper bar is activated to release the sheet and gripper 62 having a firm grip on the sheet carries the sheet straight through in the direction of the conveyor band. The conveyor band 24 and movable gripper bar 48 return around return sprocket 39 as described for beginning a subsequent printing operation at initial impression cylinder 40.

Figure 12:
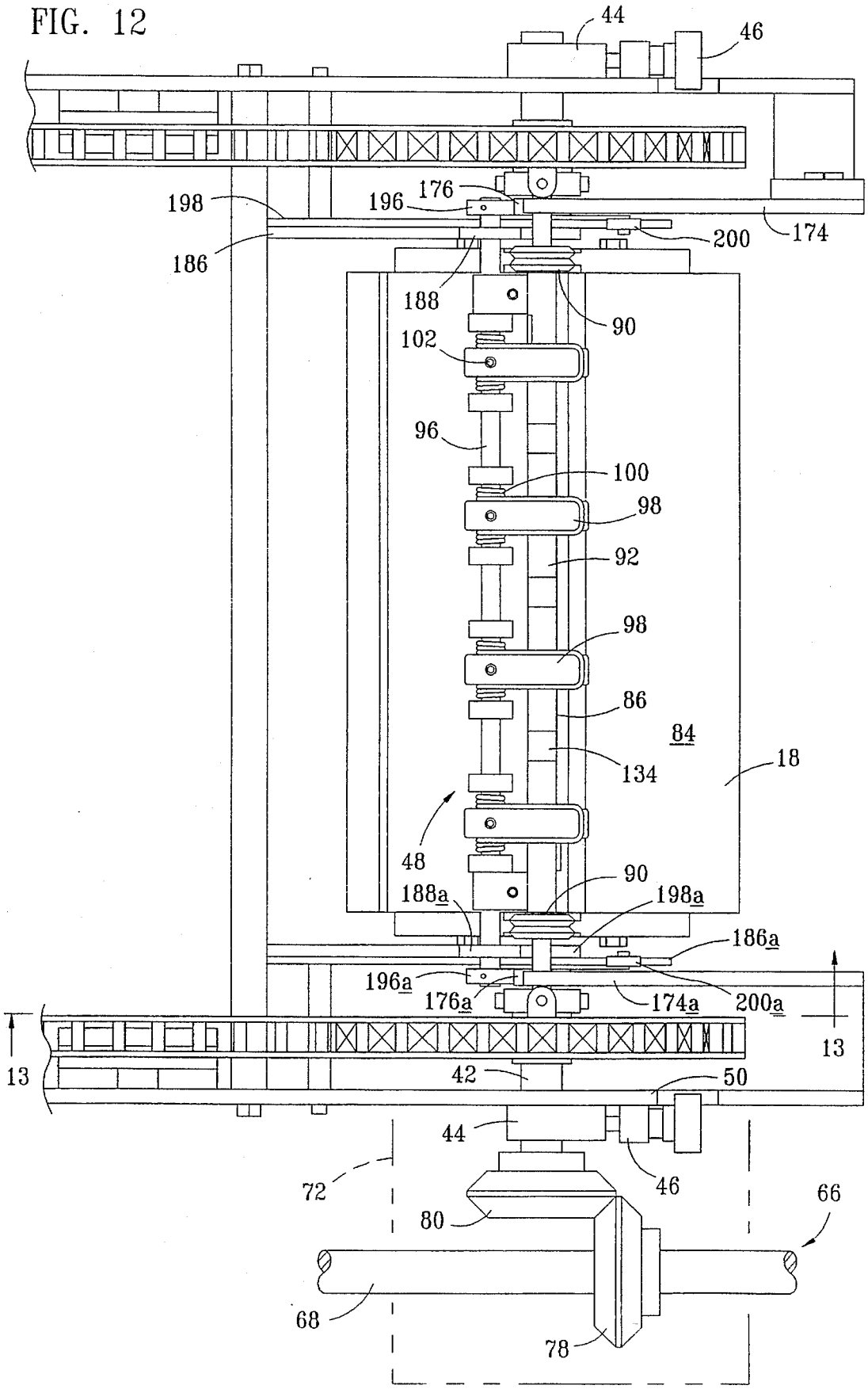
FIG. 12 is a partial top plan view detail of one alternative embodiment of an impression cylinder and transferable gripper bar according to the present invention.

Referring now to the detailed top plan view as shown in FIG. 12, the orientation and location of guide rollers 176 and 188 may be more fully understood. Also depicted are entrance guides 174 and exit guides 186 aligned for contacting rollers 176 and 188. Also depicted at the end of shaft 96 is a cam actuation arm 196 which follows a cam surface 198 as with a roller 200.

Figure 13:
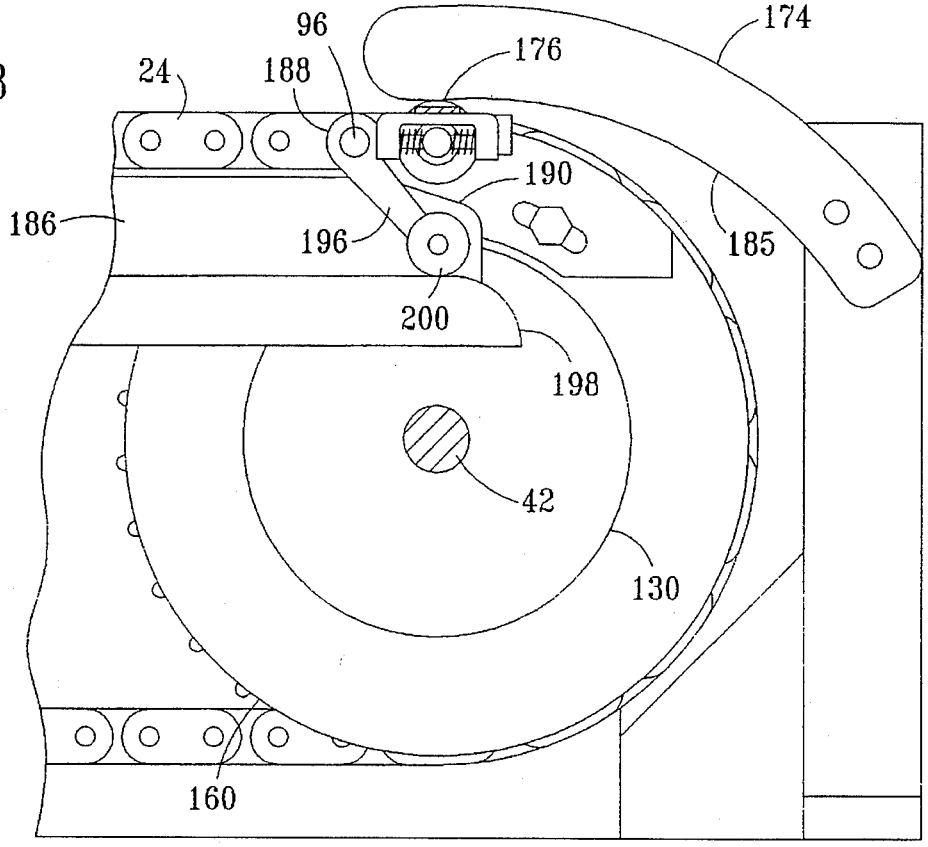
FIG. 13 is a partial cross-sectional side view taken along line 13–13 of FIG. 2.

In FIG. 13, which is a partial cross-sectional view taken along line 13—13 of FIG. 12, one preferred configuration of entrance guide surface 176 and exit guide surface 188 are more clearly depicted. Also depicted is the cam actuation arm 196 and the cam surface 198 by which the gripper fingers are raised for receiving a sheet to be printed and then subsequently lowered to firmly grab the sheet to be printed for initiation of rolling contact between the impression cylinder and the blanket cylinder.

Figure 14:
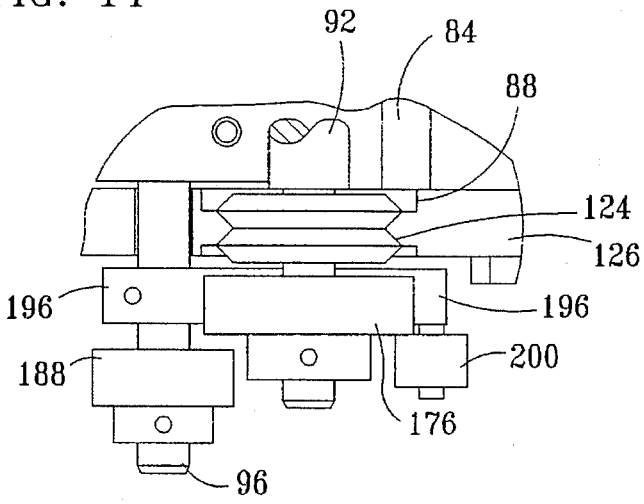
FIG. 14 is an enlarged partial top detail view of one end of a gripper bar according to one alternative embodiment as depicted in FIGS. 11 and 12.

With reference to FIG. 14, it will be understood that the positioning of exit roller 188 and cam arm 196 can be alternated or reversed in assembly order onto shaft 96 without adversely affecting the operation of the registration pocket and wheel. It will be understood by those skilled in the art that corresponding locations of cam surface 98 and exit guide 186 will likewise need to be reordered.

Figure 15:
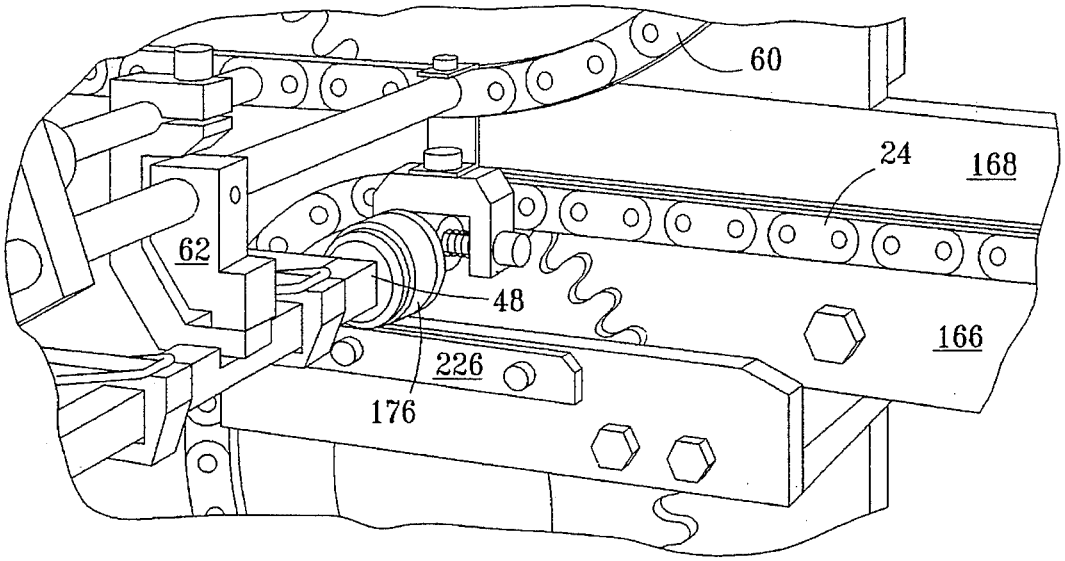
FIG. 15 is a perspective partial view of a straight through transfer mechanism showing overlapping horizontal section of conveyor band and transfer band with a gripper bar and a transfer gripper in parallel simultaneous gripping orientation.

FIG. 15 shows a partial perspective view of a straight-through transfer mechanism showing a horizontal section of conveyor band 24 and an overlapping section of transfer band 60 with a gripper bar 48 and a transfer gripper 62 in parallel, simultaneous gripping orientation. The horizontal orientation of gripper bar 48 is maintained as discussed above through the parallel guides 226 (and 224, not shown) and contacting spaced apart rollers 176 (and 188, not shown) which are at either end of gripper bar 48 and which roller 176 rolls against guide 226, as depicted in FIG. 15.

Figure 16:
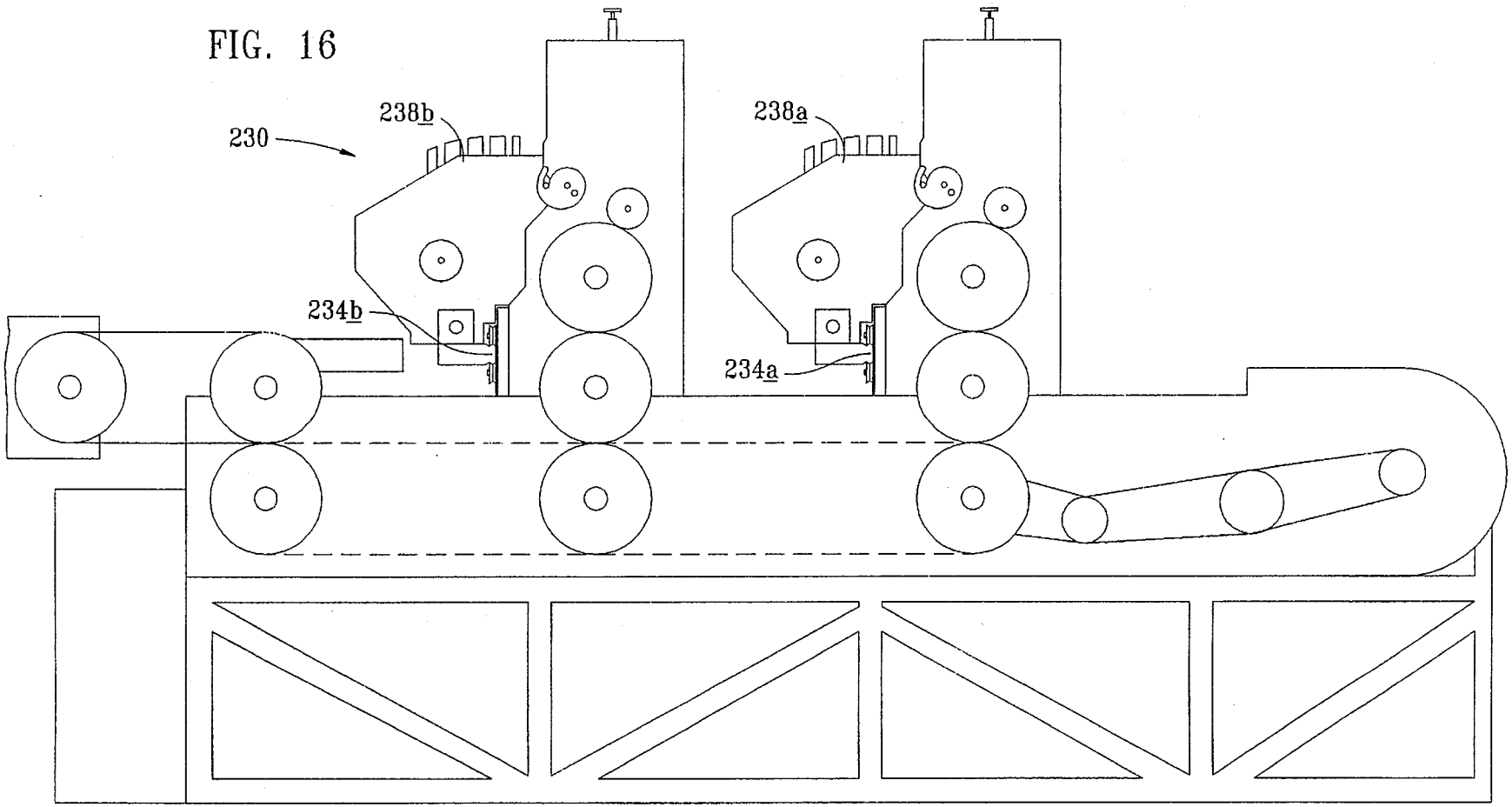
FIG. 16 is an operator side view of one embodiment of a multiple color offset printing press with horizontal slide mechanisms with inking units pivotably mounted thereon.

FIG. 16 shows an operator side view of one embodiment of a multiple color offset printing press 230. In the particular embodiment shown in FIG. 16, a two-color printing press 230 is depicted. There are horizontal slide mechanisms 234(*a*) at the first color printing position and 234(*b*) at the second color printing position. Inking units 238(*a*) and 238(*b*) are mounted on horizontal slide mechanisms 234(*a*) and 234(*b*), respectively. As will be shown in greater detail below.

Figure 17:
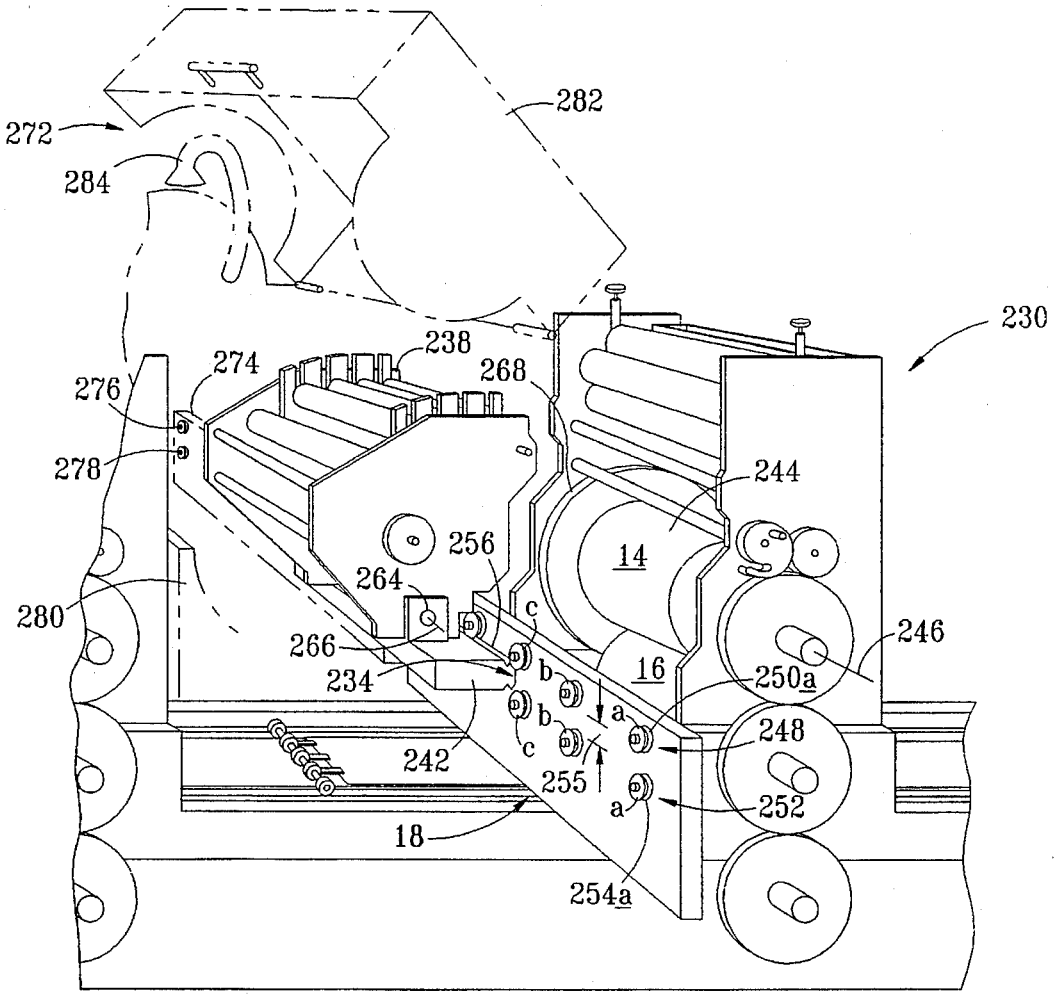
FIG. 17 is an operator partial side perspective view of the multiple color offset press of FIG. 16 with an inking unit in a supported horizontally adjacent position for access to the plate cylinder, blanket cylinder and/or impression cylinder, and further depicting a partial depiction of a receiving tray in phantom lines.

FIG. 17 shows an enlarged partial perspective view from the operator's side of a multiple offset press 230 of FIG. 16. One printing station is depicted as representative of duplicate slide mechanisms 234 at each printing station, depending on the number of print stations or colors of the press. A four-color press would have four stations with four inking units 238, four slide mechanisms 234, four sets of plate, blanket and impression cylinders and four dampening units. Each slide mechanism 234 includes a guide track 240 which is parallel and adjacent to the primary printing head cylinders (i.e. the plate, blanket and impression cylinders). Slidably engaged in the guide track 240 is a slide plate 242. The guide track 240 holds the slide plate 242 parallel to the press cylinders and permits it to slide horizontally parallel to the surface 244 of the plate cylinder 14. For a uniform diameter plate cylinder, the slide plate moves parallel to the rotational axis 246 of the plate cylinder. Thus, the inventive slide mechanism 234 allows the inking unit to move transverse to the direction of motion of the sheets 18 which are being printed.

In the preferred embodiment, the guide track 240 is formed with a first set 248 of guide rollers 250 (*a–e*), all horizontally aligned with each other. The guide track 240 also includes a second set 252 of rollers 254(*a–e*) which are also horizontally aligned with each other. The second set of rollers 252 is vertically spaced apart a predetermined distance from the first set of rollers 248. Each of the first rollers 250 has a predetermined profile surface shape for providing both vertical and horizontal components of holding force, while allowing horizontal transverse movement. Concave V-shaped rollers are used in the preferred embodiment. The second rollers 254 also have a predetermined profile surface shape which provides support in both vertical and horizontal directions, while allowing transverse horizontal movement. The guide track is thereby formed between the first set and the second set of parallel rollers. The slide plate 242, preferably, has a first ridge 256 which has a profile shape corresponding to the reverse image of the profile shape of the first rollers 250 for engagement therealong. The slide plate 242 further, preferably, includes a second parallel ridge 260 which has a profile shape 262 which corresponds to the reverse image of the profile surface of the second rollers 254. The first and second parallel ridges are spaced apart a predetermined distance which corresponds to the spacing between the first and second sets of rollers so that the ridges may be "slid" between the rollers. The rollers preferably make rolling contact, rather than actual sliding contact, along the ridges. It will be understood that a guide track could be formed, as with parallel grooves, which, with proper lubrication, could permit sliding engagement. However, the rolling engagement of the slide plate with the effective guide track formed by the rollers is found to be advantageous in its smoothness and consistency of operation without requiring significant amounts of maintenance. For example, self lubricated sealed ball bearings can be used for each of the rollers 254(*a–e*) and 250(*a–e*), thereby minimizing maintenance while maximizing the rigidity of hold as well as ease of movement of the slide plate horizontally, parallel to the plate cylinder surface.

Advantageously, the inking unit 238 is mounted to the slide plate 242 through a pivot mount 264. The pivot mount 264 provides a pivot axis 266 which is parallel to the surface 244 of plate cylinder 14. The inking unit 234, in combination with mount 264, is constructed to permit the inking unit to pivot between a first position in which the inking unit 238 is operationally engaged with the surface 244 of plate cylinder 14 to appropriately apply ink thereto. Also, inking unit drive gear 268 is engaged with the takeoff gear 270 (see FIG. 18) when inking unit 238 is pivoted into the first operationally engaged position. A second pivot position, as depicted in FIG. 17, disengages the inking unit 238 from plate cylinder 14. In this position, the inking unit can then be laterally slid on slide unit 234 to a position which is transverse to the printing sheet path. In the embodiment shown in FIG. 17, inking unit 238 is slid toward the non-operator side of the press, or to the back of the press where the operator side of the press is considered the front of the press.

In FIG. 17 there is also depicted, in partial phantom lines, a receiving tray 272 having therein a rigid receiving guide track 274. In the preferred embodiment, receiving track 274 may be constructed with upper and lower sets of guide rollers 276 and 278, respectively, which form a track substantially the same as with guide track 240. The receiving track is mounted to the receiving tray 272 in a cleaning receptacle 280 which may be provided with a movable lid 282, such as a hingably mounted lid 282. Also, preferably, the cleaning receptacle may have attached thereto a cleaning apparatus 284, for cleaning a received inking unit. The details of construction of the receiving tray 272 will be discussed more fully below with reference to FIG. 19.

Figure 18:
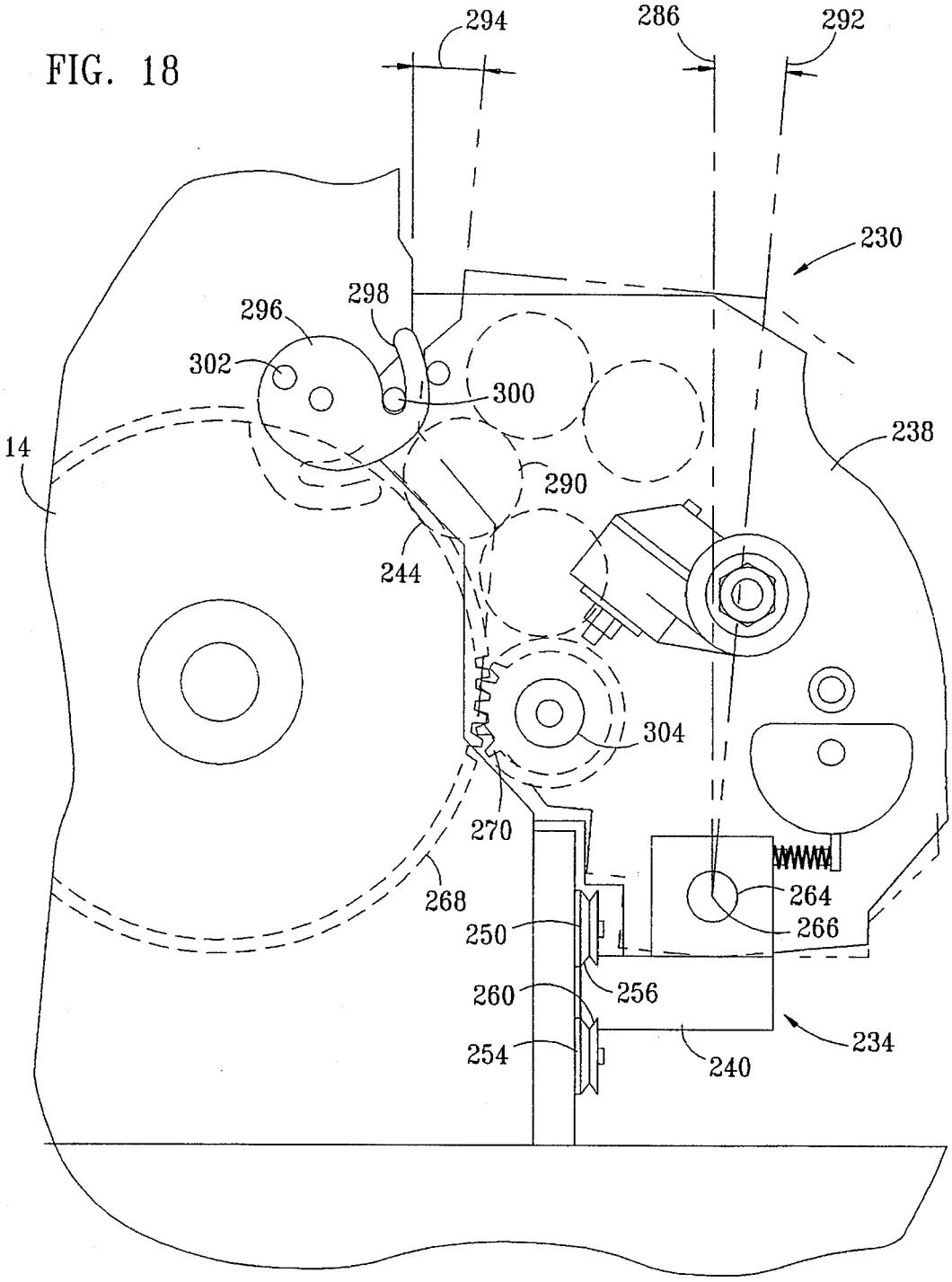
FIG. 18 is an enlarged side view showing the back side of the multiple color offset press of FIG. 16 in an engaged relationship showing a disengaged pivot position in phantom lines.

FIG. 18 depicts an enlarged partial side view showing the back side of the multi-color offset press 230 and inking unit 238. The inking unit 238 is shown in its first position in an operationally engaged relationship with plate cylinder 14 of press 230. The second pivot position in which the inking unit is disengaged is shown in phantom lines. In the first pivot position 286, both the drive gear 268 and the power takeoff gear 270 are in mesh with each other at 288. Also, at least one of the inking rollers 290 (depicted in hidden line) is engaged with the surface 244 of plate cylinder 14. In the second, or disengaged, position 292 a gap 294 is produced between the plate cylinder 14 and the inking unit 238. In the first operational position, a cam lock mechanism 296 is provided by which a progressively tighter engagement is achieved along cam ramp 298 upon rotation of lock mechanism 296. The cam lock surface 298 operates against a rigid pin 300 which is located on the inking unit 238. Preferably, duplicate cam locking units 296 are formed on both the operator side and the back side of the press, and a locking pin 302 will be formed at least on the operator side by which the cam mechanism 296 is locked so that the inking unit 238 can be secured into its operationally engaged position. In order to disengage the inking unit, the lock pin 302 would first need to be disengaged and then the com mechanism 296 could be rotated to disengage pin 300. o Also, it will be understood by those skilled in the art that moving the inking unit from the disengaged to the engaged position may sometimes require rotation of the inking unit as with a knob 304, to allow gears 268 and 272 to be properly aligned for engagement.

Figure 19:
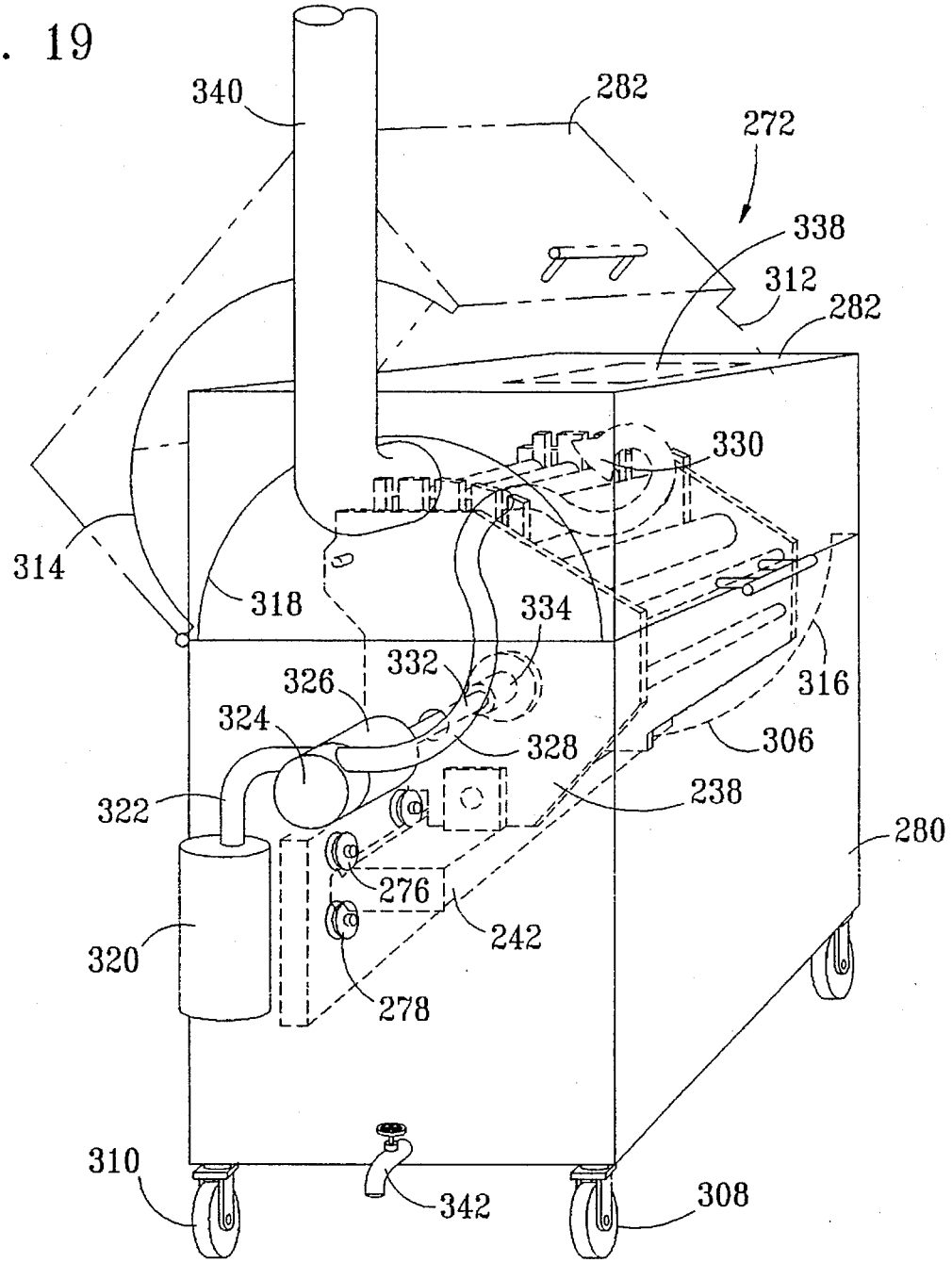
FIG. 19 is a perspective view of a slide mechanism receiving an inking unit cleaning tray.

With reference to FIG. 19, the construction of the inking unit receiving and cleaning tray 272 will be more fully understood. The inking unit 238, which continues to be pivotably mounted on slide plate 242, is received in a receiving guide track 274 which is mounted within the cleaning receptacle 280. The cleaning receptacle 280, preferably, forms a lower portion of the receiving tray 272. An opening 306 is formed which extends below the position of the receiving track 274 at one side of the cleaning receptacle 280. Sufficient opening clearance is allowed for the receiving tray 272 to be positioned immediately adjacent guide track 240, so that guide track 240 and receiving track 272 are in alignment. For this purpose, wheels 308 may be provided on the receiving tray 272 to allow is to be moved to the desired position. Also, height adjustment mechanism 400 may be provided by which the vertical position is guide track 272 can be precisely adjusted to allow easy sliding engagement. Lid 284 can be closed, as shown in FIG. 19, to totally enclose the inking unit 238. The lid is constructed with side walls 312 and 314 which correspond in shape for overlapping engagement with side walls 316 and 318 of receptacle 280.

A cleaning apparatus, generally designated 284, is advantageously provided mounted to the cleaning receptacle 280 so that the receiving and cleaning tray 272 is substantially self-contained. There is a source 320 of cleaning solvent or cleaning fluid. Preferably, the source is self-contained such as a refillable reservoir 320 for holding a cleaning fluid and which is mounted, preferably, within receptacle 280. A conduit 322 communicates the fluid to a pump 324. The pump 324 is, preferably, selectably operated with a motor 326 which may be either a low voltage DC electrical motor or, alternatively, may be a hydraulic or compressed air driven motor 326. Operator controls 327, such as a switch 327, may be positioned for easy access by the operator. The cleaning fluid from reservoir 320 is thereby pumped through conduits 322 and 328 to a directable cleaning nozzle 330. Nozzle 330 may be positioned for spraying directly onto the ink rollers of the inking unit 338 or, alternatively, may be flexibly mounted so that an operator may direct the spray as desired to particular areas to be cleaned. Also, advantageously, the motor may include a shaft 332 having a socket coupler 334 which is adapted to engage with the inking unit for driving it in rotation while the cleaning solvent is sprayed onto the ink rollers. For example, a socket which engages with positioning knob 304 may be used to accomplish this purpose. A closable access opening 328 might also be formed in lid 282 to permit the operator access for directing nozzle 330 or, alternatively, for providing a plexiglass view window by which the operation of the cleaning unit can be observed. Also, a vent 340 is provided to safely remove any evaporation of ink solvent. A drain 342 might also be provided to allow convenient removal of used solvent from the bottom of receptacle 280.

Figure 20:
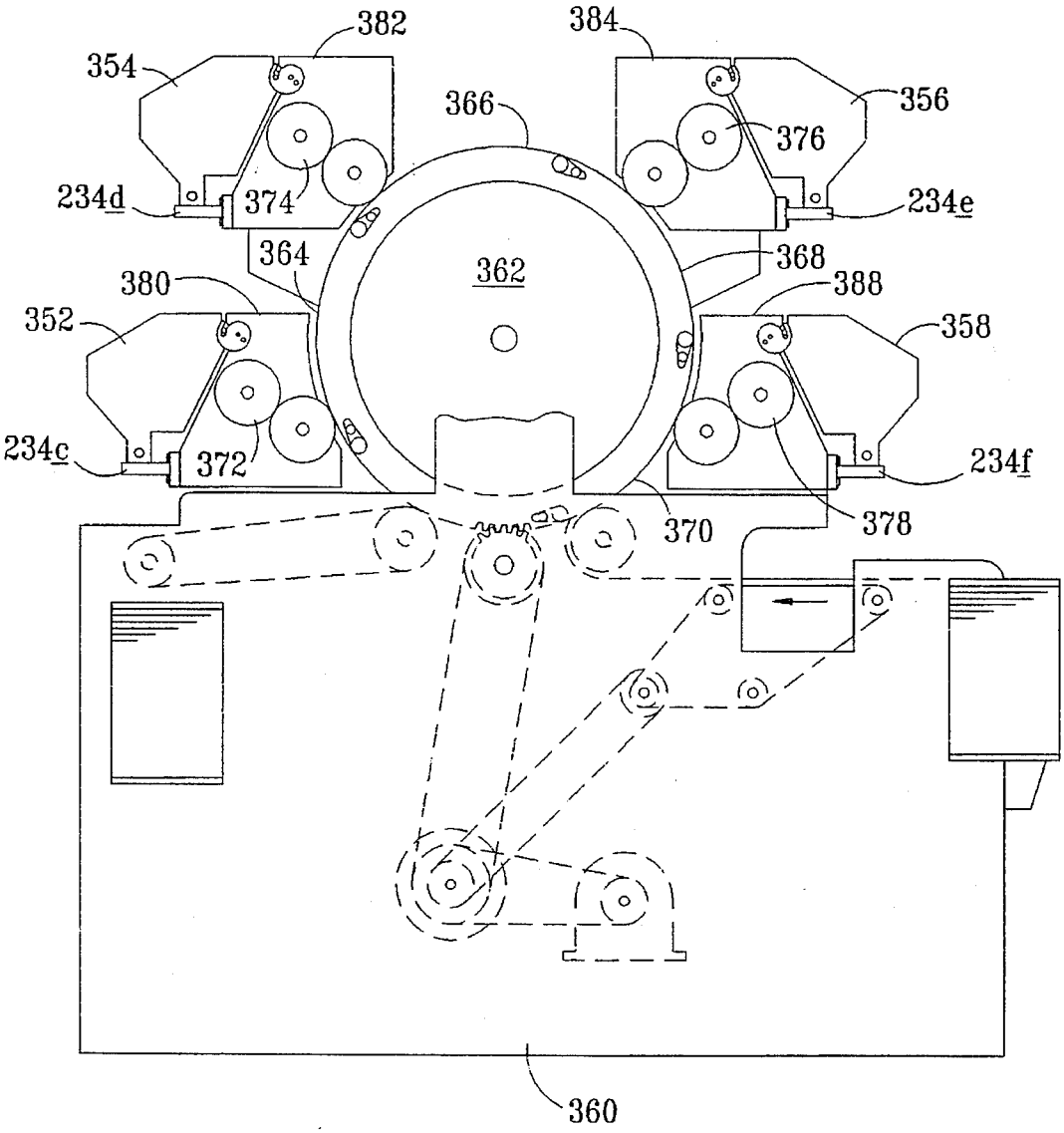
FIG. 20 is a partial cut away side elevation view of another embodiment of the slide mechanism invention on a multiple color printing press of the type having a large central impression cylinder against which a plurality of plate cylinder and blanket cylinder units operate.

FIG. 20 depicts horizontal slide mechanisms 350, 352, 354 and 356 shown attached in an alternative embodiment to a multi-color printing press 360. In this embodiment, the printing press 360 is of the type having an enlarged central impression cylinder 362 having a plurality of sheet holding areas 364, 366, 368 and 370. There are a plurality of printing units 372, 374, 376 and 378, each including a plate cylinder and a blanket cylinder. Therefore, associated with each set 372, 374, 376 and 378 of primary printing cylinders, there is a corresponding inking unit 352, 354, 356 and 358 attached, according to the present invention. Also, associated with each printing area is a dampening unit schematically depicted as 380, 382, 384 and 386. The horizontal slide mechanisms 234(*c*), 234(*d*), 234(*e*) and 234(*f*) are attached to inking units 352, 354, 356 and 358 with a construction corresponding to the construction as described with respect to inking unit 238, and corresponding slide mechanism 234, as discussed with respect to FIGS. 16, 17, 18 and 19, except that slide mechanisms 234(*e*) and 234(*f*) are shown in a reverse direction. For some presses, it may be possible to mount a slide mechanism 234(*e*) and 234(*f*) in the same orientation as with the slide mechanisms 234(*c*) and 234(*d*). Such a construction may be advantageous for purposes of having a consistent ink receptacle and cleaning tray construction. This is not necessary for some aspects of the invention. In any press configuration where it is more convenient to mount the inking units in reverse directions, the slide mechanisms can also be advantageously reserved. In those instances, as shown in FIG. 20, either separate receiving and cleaning trays may be used or, alternatively, receiving and cleaning trays having entry thereinto from both directions may be conveniently constructed.

Thus, what has been disclosed is a horizontal slide mechanism and system for replaceably removing and cleaning inking units on a rotary offset printing press. The invention is useable with presses having single or multiple color printing capabilities. Inking units can be moved laterally out of the sheet path, both for access to the printing cylinders and also for cleaning and/or replacement with an inking unit which is set up with another desired color.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A horizontal slide mechanism for removably replacing an inking unit set in a rotary offset printing press of the type having a plate cylinder, a blanket cylinder and an impression cylinder having parallel rotational axes; said horizontal slide mechanism comprising:

(a) a guide track rigidly mounted to said printing press adjacent and parallel to said plate, blanket and impression cylinders;

(b) a slide plate, supported in said guide track for guided movement parallel to said plate, blanket and impression cylinder transverse to the printing press;

(c) a pivot mount attached to said slide plate and pivotably attached to said inking unit, said pivot mount on said slide plate providing a single pivot axis parallel to said rotational axes of said plate, blanket and impression cylinders, and positioned spaced apart from said plate cylinder for pivoting said inking unit between a first and second pivot position with said first pivot position corresponding to inking engagement with said plate cylinder, and said second pivot position corresponding to a spaced apart disengaged position, at which said inking unit is not in operational engagement with said plate cylinder; and (d) a latching mechanism by which said inking unit is releasably held and locked in said first position corresponding to inking engagement.

2. A horizontal slide mechanism, as in claim 1, for removably replacing an inking unit set in a rotary offset printing press of the type having a plate cylinder, a blanket cylinder and an impression cylinder having parallel rotational axes; said horizontal slide mechanism comprising:

(a) said guide track includes a first plurality of horizontally aligned rollers having a first predetermined profile shape and a second plurality of horizontally aligned rollers having a second predetermined profile shape, said first and second sets of horizontally aligned rollers spaced apart from each other a predetermined vertical distance; and (b) said slide plate includes a first horizontal ridge having a cross-sectional shape corresponding to a reverse image of said first predetermined profile shape of said rollers of said first set of rollers for rolling engagement therewith, and a second horizontal ridge having a predetermined cross-sectional shape corresponding to a reverse image of said second predetermined profile shape parallel to and spaced apart said predetermined distance from said first horizontal ridge for simultaneous rolling engagement with said second set of horizontally aligned rollers.

3. A horizontal slide mechanism, as in claim 2, wherein said profile shape of said rollers is a concave "V" shape, and said corresponding profile shape of said first and second ridges of a convex "V" shape.

4. A horizontal slide mechanism, as in claim 1, wherein said guide track and said slide plate overlap in opposite directions for supporting the inking unit outboard from said press for access to the press printing cylinders without removal of the inking unit.

5. A horizontal slide mechanism, as in claim 1, wherein said latching mechanism is a cam lock mechanism by which a cam groove is rotated for engagement with a rigid pin for progressively tightening and securely holding the inking unit in a first engaged operational position.

6. A horizontal slide mechanism, as in claim 1, further comprising a drive gear on said printing press and a power takeoff gear on said inking unit, which drive gear and power takeoff gear are positioned for intermeshing engagement with said horizontal slide mechanism pivoted into said first position, and which gears disengage when said horizontal slide mechanism pivots the inking unit into the second disengaged position.

7. A horizontal slide mechanism, as in claim 1, further comprising:

(a) receiving tray having a receiving track mounted horizontally therein, said receiving track having a shape corresponding to that of said guide track for receiving the slide plate thereinto.

8. A horizontal slide mechanism, as in claim 7, wherein said receiving tray further comprises pivot mounted wheels for adjustably and removably positioning said receiving tray adjacent to said guide track for receiving said slide plate thereinto.

9. A horizontal slide mechanism, as in claim 8, wherein said receiving tray further comprises height adjusters by which the vertical position of the receiving track can be positioned for receiving the slide plate thereinto.

10. A horizontal slide mechanism, as in claim 7, wherein said receiving tray further comprises an inking unit cleaning apparatus.

11. A horizontal slide mechanism, as in claim 10, wherein said cleaning apparatus comprises:

(a) a source of ink cleaning solvent;

(b) a selectably activatable solvent pump;

(c) a conduit extending from said solvent source to said solvent pump;

(d) a solvent spray nozzle communicatingly coupled to said selectably activatable pump for directing pumped cleaning solvent onto the inking unit.

* * * * *

UNITED STATES PATENT AND TRADEMARK OFFICE

CERTIFICATE OF CORRECTION

PATENT NO. : 5,590,598

DATED : January 7, 1997

INVENTOR(S) : James J. Keller

It is certified that error appears in the above-indentified patent and that said Letters Patent is hereby corrected as shown below:

Column 1, Lines 42 & 45 --
Replace: "bluet"
With: -- blanket --

Column 2, Line 4 --
Replace: "transtar"
With: -- transfer --

Column 3, Line 5 --
Replace: "withore"
With: -- without --

Signed and Sealed this

Tenth Day of June, 1997

Bruce Lehman

*Attest:*

BRUCE LEHMAN

*Attesting Officer*

*Commissioner of Patents and Trademarks*